US007493065B2

(12) United States Patent
Kamijo et al.

(10) Patent No.: US 7,493,065 B2
(45) Date of Patent: Feb. 17, 2009

(54) WIRE BAR, METHOD OF MANUFACTURING WIRE BAR, AND IMAGE FORMING APPARATUS

(75) Inventors: Koichi Kamijo, Nagano-ken (JP); Hidehiro Takano, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/196,531

(22) Filed: Aug. 2, 2005

(65) Prior Publication Data

US 2006/0034638 A1 Feb. 16, 2006

(30) Foreign Application Priority Data

Aug. 16, 2004 (JP) ..... 2004-236499
Nov. 16, 2004 (JP) ..... 2004-331445
Nov. 18, 2004 (JP) ..... 2004-333983

(51) Int. Cl.
*G03G 15/10* (2006.01)

(52) U.S. Cl. ..... 399/239

(58) Field of Classification Search ..... 399/237, 399/233, 239, 249
See application file for complete search history.

(56) References Cited

U.S. PATENT DOCUMENTS 3,993,024 A * 11/1976 Stansell ..... 399/239
4,282,303 A * 8/1981 Bergen ..... 399/239
5,937,247 A 8/1999 Takeuchi et al.
5,999,779 A 12/1999 Takeuchi
6,571,077 B2 * 5/2003 Thompson et al. ..... 399/274
2004/0005407 A1 * 1/2004 Takeuchi et al. ..... 427/240

FOREIGN PATENT DOCUMENTS

JP 10-340004 12/1998
JP 11-153906 6/1999
JP 11-174851 7/1999

OTHER PUBLICATIONS

English abstract of JP 2002-148948.*
English abstract of JP 2004-038172.*
English abstract of JP 2004-177569.*

* cited by examiner

*Primary Examiner*—David M Gray
*Assistant Examiner*—Ruth N Labombard
(74) *Attorney, Agent, or Firm*—Hogan & Hartson LLP

(57) ABSTRACT

A wire bar is formed by winding a wire, which comprises a first flat portion formed along an overall longitudinal length, around a peripheral surface of a metal core such that the peripheral surface of the metal core and the first flat portion tightly contact with each other. Since this increases the area size of a contact portion where the wire and the metal core contact each other, it is possible to increase the force of static friction which fixes the wire to the metal core. Fixing of the wound wire to the metal core by the strong force of static friction effectively prevents the wound wire from getting deviated.

10 Claims, 20 Drawing Sheets

FIG. 19A : BEFORE WINDING STEP
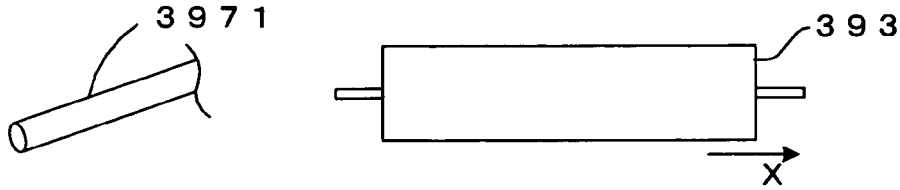
FIG. 19B : AFTER WINDING STEP
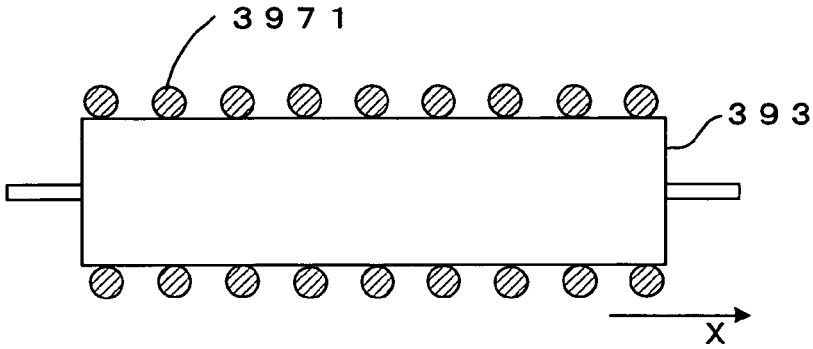
FIG. 19C : REGULATOR SURFACE PORTION FORMING STEP
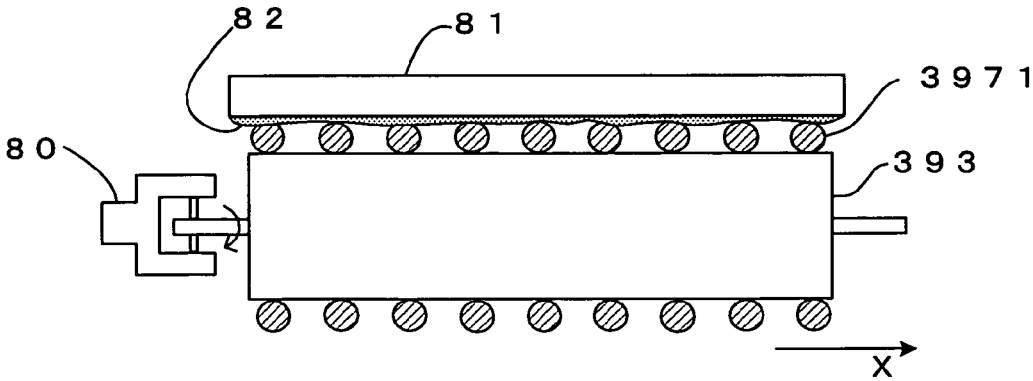
FIG. 19D : AFTER REGULATOR SURFACE PORTION FORMING STEP
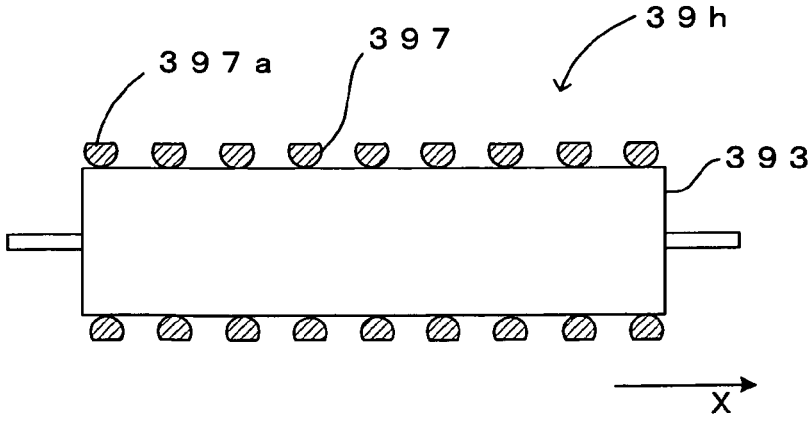

FIG. 23A : BEFORE WINDING STEP
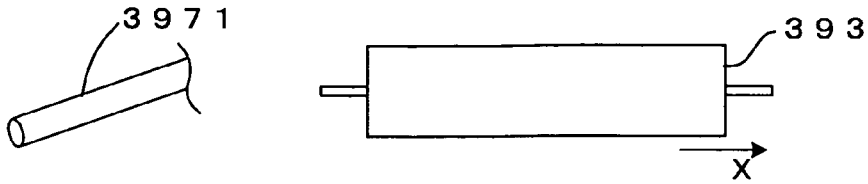
FIG. 23B : AFTER WINDING STEP
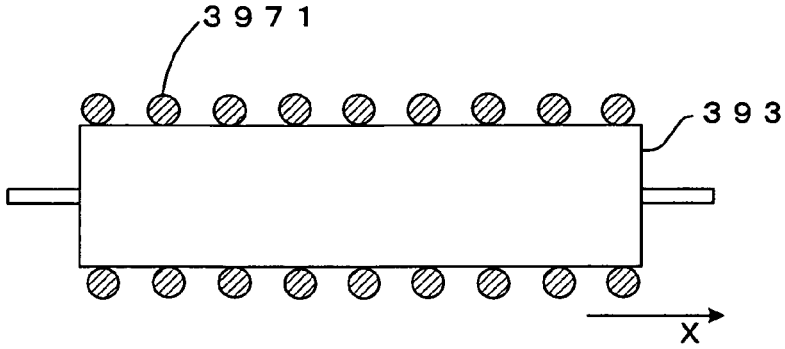
FIG. 23C : REGULATOR SURFACE PORTION FORMING STEP
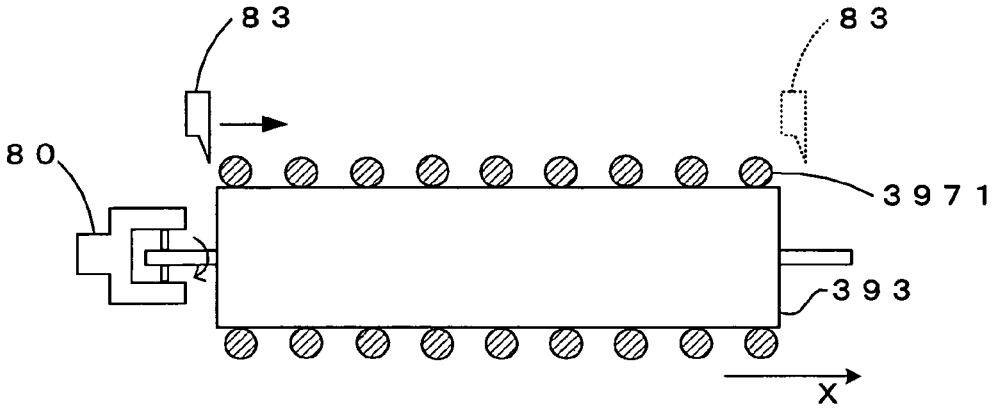
FIG. 23D : AFTER REGULATOR SURFACE PORTION FORMING STEP
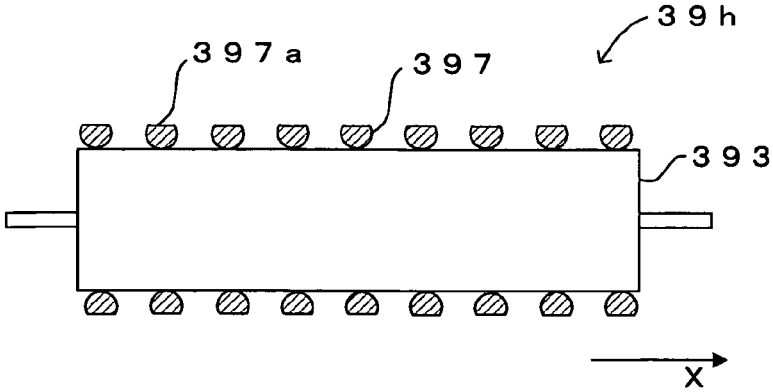

WIRE BAR, METHOD OF MANUFACTURING WIRE BAR, AND IMAGE FORMING APPARATUS

CROSS REFERENCE TO RELATED APPLICATION

The disclosure of Japanese Patent Applications enumerated below including specification, drawings and claims is incorporated herein by reference in its entirety:

No. 2004-236499 filed Aug. 16, 2004;

No. 2004-331445 filed Nov. 16, 2004; and

No. 2004-333983 filed Nov. 18, 2004.

BACKGROUND OF THE INVENTION

1. Field of the Invention

The present invention relates to an image forming technique of the electrophotographic type for a printer, a copier machine, a facsimile machine and the like, and more particularly, to an image forming technique which uses liquid development as a development method.

2. Description of the Related Art

Known as a conventional image forming apparatus utilizing liquid development is a structure in which an electrostatic latent image formed on a photosensitive member (latent image carrier) is developed with a liquid developing agent which is evenly applied in a constant thickness to a surface of a developing agent carrier such as a developer belt and a developer roller and an image without any density variation is formed. As a technique for uniformly applying a liquid developing agent to a surface of a developing agent carrier, the following technique has been proposed. That is, a constant and measured amount of a liquid developing agent is uniformly formed temporarily as a thin film having a constant thickness on a surface of a coating roller and the liquid developing agent uniformly provided on the surface of the coating roller is then applied to a surface of the developing agent carrier, and the surface of the developing agent carrier is evenly coated with the liquid developing agent.

For instance, in the apparatus described in Japanese Unexamined Patent Publication No. H11-153906, a developing agent carrier is formed by a developer belt and a coating roller, and for application of a liquid developing agent to the developing agent carrier, a wire bar is disposed which is obtained by winding a wire around a surface of a metal core (rod-like member). In the case of this wire bar, carrying portions between the wire sections of thus wound wire carry a constant amount of the liquid developing agent. The constant amount of the liquid developing agent carried by the wire bar is supplied to the coating roller from the wire bar as the wire bar and the coating roller rotate while abutting on each other at a predetermined position, and a thin layer of the liquid developing agent having a constant thickness is temporarily formed on a surface of the coating roller. At last, as the thin layer of the liquid developing agent uniformly formed in the constant thickness on the coating roller is applied to the developer belt, the thin layer of the liquid developing agent having the constant thickness is formed on a surface of the developer belt.

Meanwhile, as a structure that the developing agent carrier is formed by a developer roller, such a structure is known in which the coating roller is formed by the wire bar above and the thin layer of the liquid developing agent having the constant thickness is formed on the surface of the developer roller. In other words, as described above, as the wire bar and the developer roller rotate while abutting on each other at the predetermined position, a constant amount of the liquid developing agent carried in the carrying portions of the wire bar is applied directly to the developer roller from the wire bar, and the thin layer of the liquid developing agent having the constant thickness is formed on the surface of the developer roller.

SUMMARY OF THE INVENTION

By the way, for efficient application of the liquid developing agent carried by the carrying portions of the wire bar to the developing agent carrier such as the coating roller and the developer roller, in the abutting portion between the wire bar and the developing agent carrier, the surface of the wire bar and that of the developing agent carrier need to be in contact under pressure with each other. Noting this, the conventional approaches often require fixing rotation axes at the both ends of the wire bar and the developing agent carrier when disposing the wire bar and the developing agent carrier while satisfying the condition below:

(the axis-to-axis distance between the rotation axes of the wire bar and those of the developing agent carrier)≦(the sum of the radius of a cross sectional surface perpendicular to the direction of the rotation axes of the wire bar and the radius of a cross sectional surface perpendicular to the direction of the rotation axes of the developing agent carrier)

In other words, with the rotation axes at the both ends of the wire bar and the developing agent carrier fixed satisfying this condition, it is possible to bring the surface of the wire bar and that of the developing agent carrier into pressure contact with each other in the abutting portion between the wire bar and the developing agent carrier.

However, an apparatus structured as such sometimes causes the following problems. That is, at the both ends of the wire bar and the developing agent carrier, the rotation axis of the wire bar and that of the developing agent carrier each disposed on one side are under strong force which tries to move these rotation axes closer to each other and the rotation axis of the wire bar and that of the developing agent carrier each disposed on the other side are also under similar force. Hence, in a central portion of the wire bar particularly along the direction of the rotation axes, the wire bar is subjected to force which tries to move it away from the developing agent carrier, and the wire bar is distorted in its central portion. This could loosen or deviate the wire which is wound around the surface of the metal core, in the central portion of the wire bar. The conventional technique mentioned above provides no consideration on this, leaving a room for improvement of the technology.

By the way, in the conventional apparatus above, as shown in FIG. 24, as a regulator blade (regulator member) 350 contacts a wire body 391*a* which is obtained by winding a wire 391 around a metal core (rod-like member) 393, the regulator blade 350 scrapes off an excessive amount of a liquid developing agent carried on the surface of the wound wire 391, and as a result, the liquid developing agent carried by the wire bar 39 is regulated to a constant amount. FIG. 24 is a drawing which shows the regulator member as it is disposed in contact with the wire bar in the conventional apparatus. The (wound) wire 391 is fixed to the metal core 393 by the force of static friction which acts upon a contact portion 39*b* with the metal core 393, thereby forming the wire body 391*a*. However, as shown in FIG. 24, since the wire 391 and the metal core 393 contact each other in a small area size within the contact portion 39*b*, the following problems could occur. That is, since the amount of the liquid developing agent on the wire bar 39 is restricted as the regulator blade 350 contacts the wire body 391*a*, the force of sliding friction develops in a contact portion 39*c* where the regulator blade 350 contacts the wire body 391*a*. This force of sliding friction may sometimes grow beyond the force of static friction which fixes the wire 391 to the metal core 393. When this occurs, the wound wire 391 can not stay fixed at its position upon manufacturing the wire bar 39, namely, its designed position and the respective sections of the wound wire 391 could therefore get deviated from their designed positions. Deviation of the wire 391 leads to various types of adverse influences. For instance, the volume of carrying portions 392 formed between the adjacent sections of the wound wire 391 change, which makes the amount of the liquid developing agent carried by the wire bar 39 uneven along the longitudinal direction (the left-to-right direction in FIG. 24) X of the wire bar 39. In addition, a coated pattern created by the wire bar 39 may become different from a designed pattern. Prevention of deviation of the wound wire 391 is thus important in an image forming apparatus utilizing liquid development.

Further, the wire 391 at its peripheral surface contacts the regulator blade 350. Since this reduces the area size of the portion where the wire 391 contacts the regulator blade 350 within the contact portion 39*c* as shown in FIG. 24, the following problem could occur. That is, as the regulator blade 350 scrapes off an excessive amount of the liquid developing agent from the wire bar 39, leaving the liquid developing agent which is carried by the carrying portions 392 between the wound sections of the wire 391 which forms the wire body 391*a*, the amount of the liquid developing agent carried by the wire bar 39 is regulated. However, as described above, since the wire 391 contacts the regulator blade 350 in a small area within the contact portion 39*c*, the regulator blade 350 may get into the carrying portions 392 and scrape off the liquid developing agent from the wire bar 39 more than expected amount. In addition, due to the small contacting area size between the wire 391 and the regulator blade 350, contacting of the wire 391 with the regulator blade 350 may become instable in the contact portion 39*c*, and therefore, regulation (scraping off) of the excessive liquid developing agent on the wire bar 39 by the regulator blade 350 may become instable. This makes it impossible to stably restrict the amount of the liquid developing agent on the wire bar 39, and when the liquid developing agent is applied to the developing agent carrier, the coated pattern of the liquid developing agent applied to the developing agent carrier is disturbed and the accuracy of development deteriorates.

The invention has been made in light of these problems, and accordingly, a first object of the invention is to effectively prevent deviation of a wire wound around a rod-like member in a wire bar which is obtained by winding the wire around a peripheral surface of the rod-like member.

A second object of the invention is to provide a wire bar which achieves stable scraping off a liquid with a regulator member and provide a method of manufacturing this wire bar.

A third object of the invention is to provide a technique which always secures favorable contact of a wire bar at a coating position with a developing agent carrier by preventing loosening of a wire wound around the wire bar.

A fourth object of the invention is to provide an image forming apparatus which prevents a coated pattern of a liquid developing agent applied by a wire bar to a developing agent carrier from getting disturbed, and which accordingly improves the accuracy of development.

The present invention is directed to a wire bar which has a surface which carries a liquid and comes into contact with a regulator member, whereby an excessive amount of the liquid on the surface of the wire bar is scraped off. According a first aspect of the present invention, the wire bar comprises: a rod-like member; and a wire which has a first flat portion longitudinally formed in its peripheral surface, wherein the wire is wound around a peripheral surface of the rod-like member so that the first flat portion contacts the peripheral surface of the rod-like member.

According a second aspect of the present invention, the wire bar comprises: a rod-like member; and a wire which is wound around a peripheral surface of the rod-like member, wherein the wire, which is wound around the peripheral surface of the rod-like member, has a regulator surface portion which is approximately parallel to the peripheral surface of the rod-like member and has a predetermined width along the longitudinal direction of the rod-like member, and the regulator surface portion abuts on the regulator member.

The present invention is also directed to a method of manufacturing the wire bar according to the second aspect. According to a third aspect of the present invention, the method comprises: a winding step of winding an unprocessed wire about the rod-like member; and a regulator surface portion forming step of forming the regulator surface portion in the wound unprocessed wire after the winding step.

The present invention is also directed to an image forming apparatus using liquid development. According to a fourth aspect of the present invention, the apparatus comprises: (a) a latent image carrier which carries an electrostatic latent image; and (b) a developing unit comprising (b-1) the wire bar according to the first aspect, (b-2) a regulator member which contacts a surface of thus wound wire, scrapes off an excessive amount of a liquid developing agent carried on the surface of thus wound wire and restricts the amount of the liquid developing agent carried on the wire bar, and (b-3) a developing agent carrier which is coated with the liquid developing agent by the wire bar after the liquid developing agent is restricted by the regulator member, wherein the developing unit forms a toner image by developing the electrostatic latent image on the latent image carrier with the liquid developing agent which is carried by the developing agent carrier.

According to a fifth aspect of the present invention, the apparatus comprises: (a) a latent image carrier which carries an electrostatic latent image; and (b) a developing unit comprising (b-1) the wire bar according to the second aspect, (b-2) a regulator member which contacts a surface of thus wound wire, scrapes off an excessive amount of a liquid developing agent carried on the surface of thus wound wire and restricts the amount of the liquid developing agent carried on the wire bar, and (b-3) a developing agent carrier which is coated with the liquid developing agent by the wire bar after the liquid developing agent is restricted by the regulator member, wherein the developing unit forms a toner image by developing the electrostatic latent image on the latent image carrier with the liquid developing agent which is carried by the developing agent carrier.

The present invention is also directed to an image forming apparatus in which a liquid developing agent held in a developing agent housing part is scooped up, and after application of the liquid developing agent to a developing agent carrier, an electrostatic latent image on a latent image carrier is developed using the liquid developing agent which is carried by the developing agent carrier and a toner image is formed. According to a sixth aspect of the present invention, the apparatus comprises: (a) a wire bar which comprises (a-1) a rod-like member and (a-2) a wire which is wound around a coating area which is provided in a surface of the rod-like member, the wire bar making the wire contact the liquid developing agent held inside the developing agent housing part while rotating to thereby carry the liquid developing agent on the adjacent sections of thus wound wire and scoop up the liquid developing agent from the developing agent housing part, the wire bar contacting the developing agent carrier at a coating position while rotating to thereby apply the developing agent to the developing agent carrier; and (b) a regulator member which contacts the wire on the upstream side to the coating position along a direction of rotations of the wire bar, and accordingly restricts the amount of the developing agent carried on the coating area, wherein along the longitudinal direction of the wire bar which is approximately orthogonal to the direction of rotations, the width of the regulator member is longer than the width of the coating area, a central portion of the regulator member contacts the wire, each end of the regulator member is located on the outer side to the coating area, and with the regulator member in contact with the wire, the gap between each end of the regulator member and the surface of the rod-like member is shorter than the gap between the central portion of the regulator member and the surface of the rod-like member, and a step is formed at the boundary between the central portion of the regulator member and each end of the regulator member.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 19A to 19D are drawings which show the respective steps through which the wire bar is manufactured.

FIGS. 23A to 23D are drawings which show the respective steps through which the wire bar is manufactured.

DETAILED DESCRIPTION OF THE PREFERRED EMBODIMENTS

First Embodiment

Figure 1:
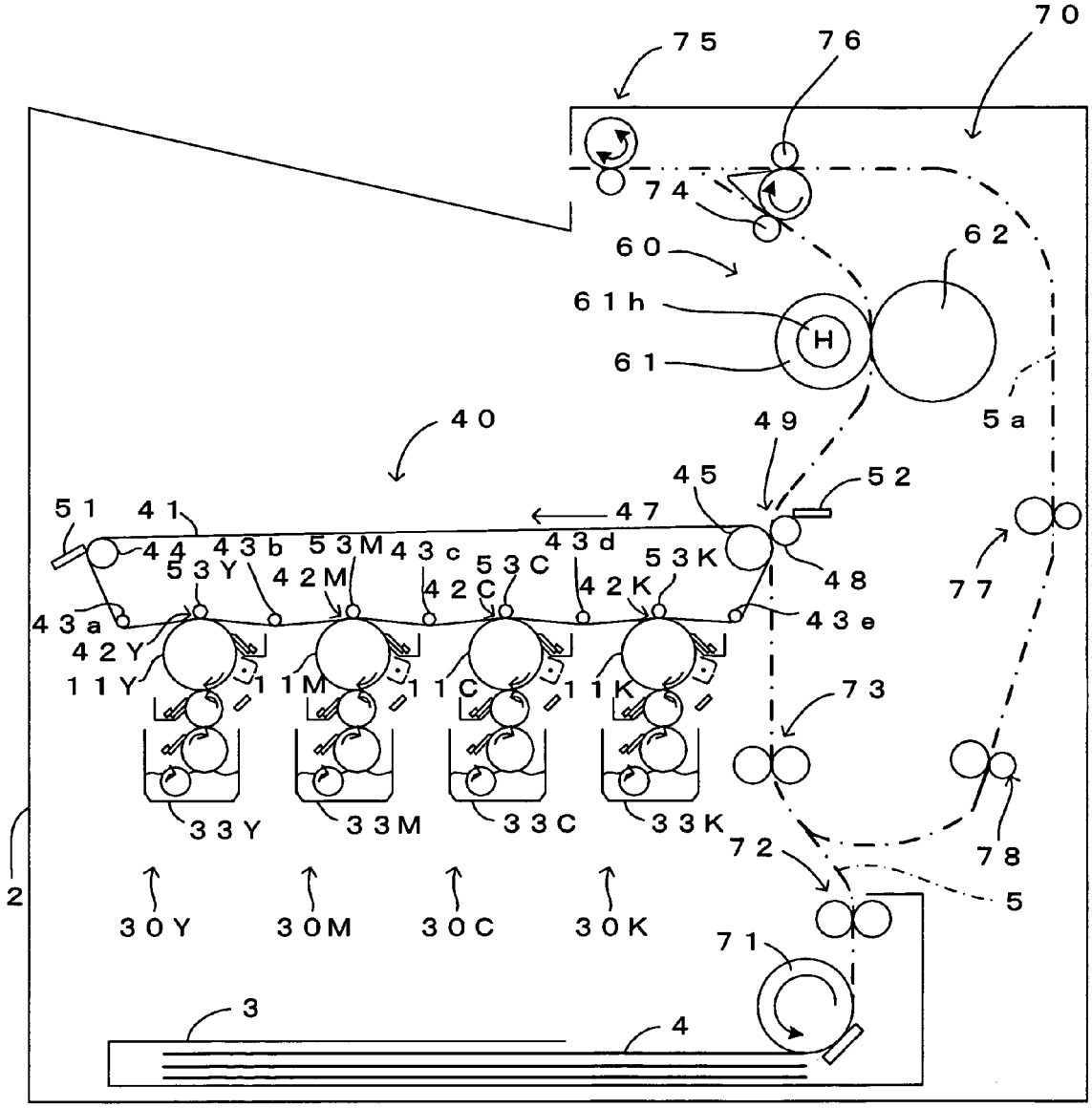
FIG. 1 is a drawing which shows the internal structure of a printer, a first embodiment of an image forming apparatus according to the invention.
Figure 2:
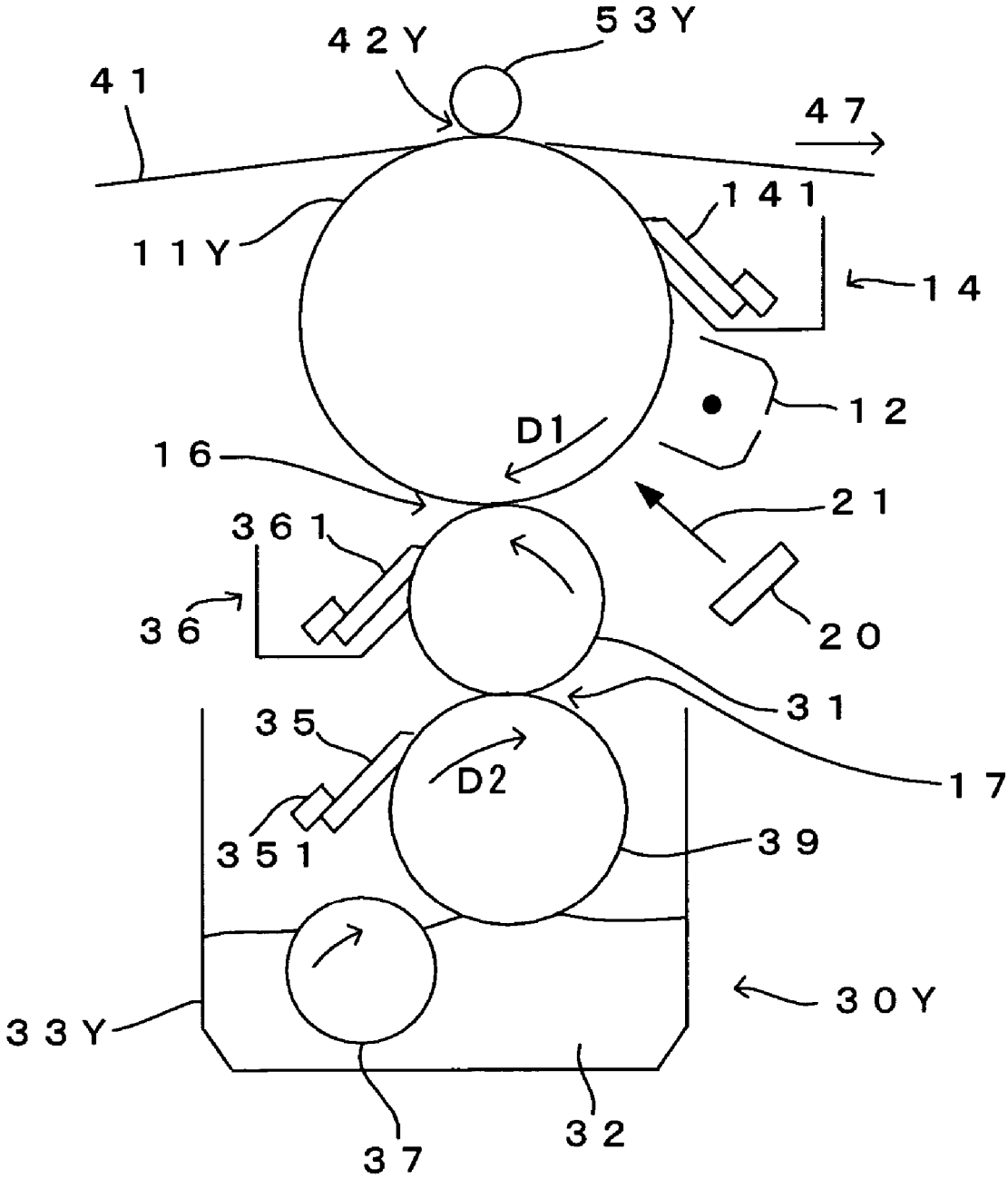
FIG. 2 is an enlarged view of an essential part in FIG. 1.
Figure 3:
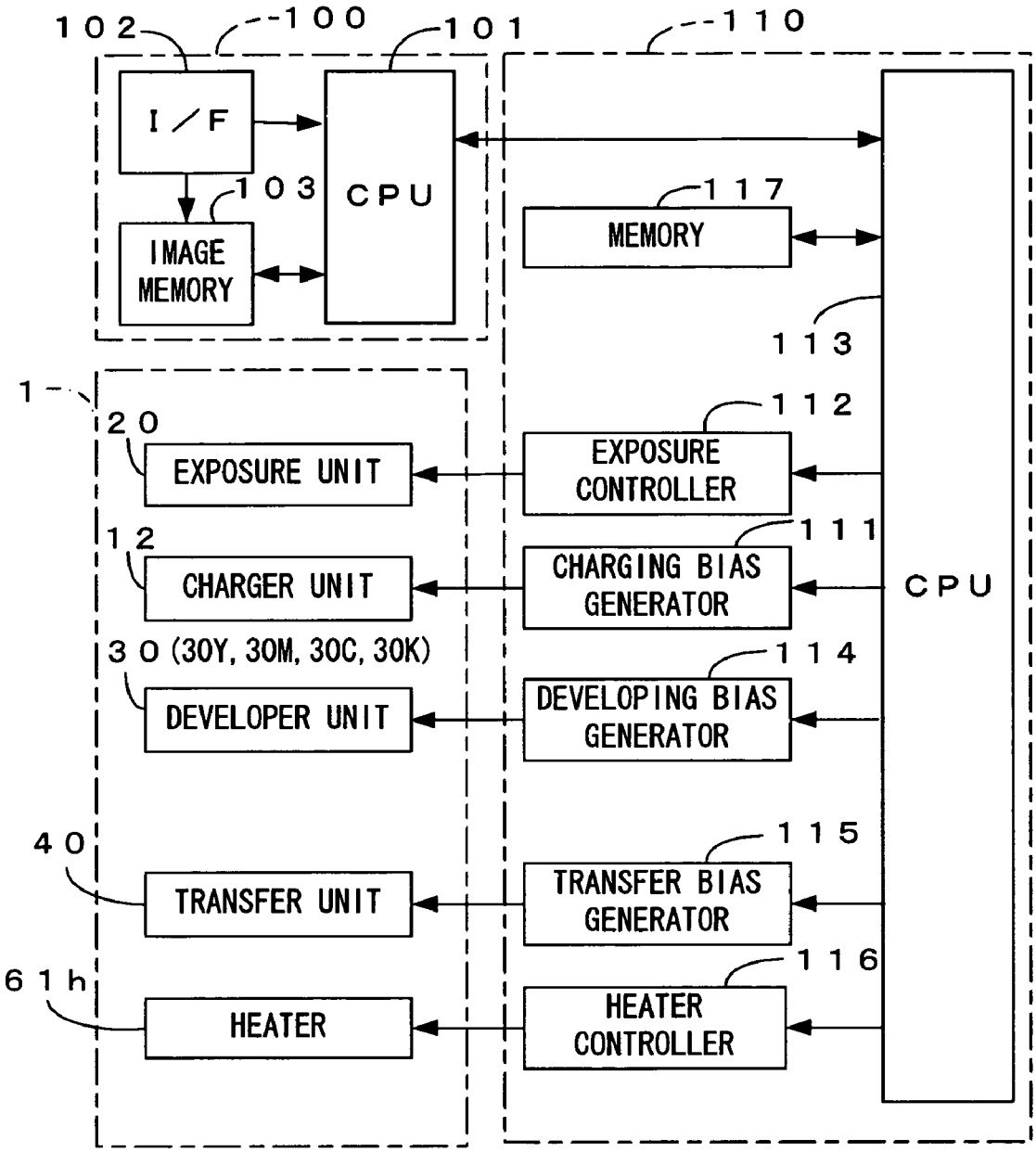
FIG. 3 is a block diagram which shows the electric structure of the printer.

FIG. 1 is a drawing which shows the internal structure of a printer, a first embodiment of an image forming apparatus according to the invention. FIG. 2 is an enlarged view of an essential part in FIG. 1, and FIG. 3 is a block diagram which shows the electric structure of the printer. This image forming apparatus is a color printer of the so-called tandem type, and photosensitive members 11Y, 11M, 11C and 11K for the four colors of yellow (Y), magenta (M), cyan (C) and black (K) are disposed as the "latent image carrier" of the invention parallel to each other inside a main apparatus section 2. A liquid development method is implemented in this printer, to thereby superimpose toner images carried on the photosensitive members 11Y, 11M, 11C and 11K upon each other and form a full color image, or form a monochrome image using a black (K) toner image alone. In this printer, as a print command signal containing an image signal is fed to a main controller 100 from an external apparatus such as a host computer, an engine controller 110 controls respective portions of an engine part 1 in accordance with a control signal received from the main controller 100, and an image which corresponds to the image signal is printed on a recording medium 4, which may be a transfer paper, a copy paper or a transparency for an overhead projector, which is transported from a paper feed cassette 3 which is disposed in a lower portion of the main apparatus section 2.

In the engine part 1, a charger unit 12, an exposure unit 20, a developer unit 30 (30Y, 30M, 30C, 30K) and a photosensitive unit cleaner 14 are disposed respectively for the four photosensitive members 11Y, 11M, 11C and 11K disposed parallel to each other along the direction of rotations 47 of an intermediate transfer belt 41 which is one part of a transfer unit 40. Each one of the developers 30Y, 30M, 30C and 30K comprises a tank 33 (33Y, 33M, 33C, 33K) (which corresponds to the "developing agent housing part" of the invention) which stores a liquid developer 32 in which toner of each color is dispersed. The structures of the charger unit 12, the exposure unit 20, the developer unit 30 and the photosensitive unit cleaner 14 are the same across all toner colors. Hence, the structures for yellow alone will be described below, and those for the other toner colors will be simply denoted at the same or corresponding reference symbols but will not be described.

As shown in FIG. 2, the photosensitive member 11Y is disposed for free rotations in the direction of the arrow D1 (the clockwise direction in FIG. 2), and the diameter of the photosensitive member 11Y is approximately 40 mm. Around the photosensitive member 11Y, the charger unit 12, a developer roller 31, a discharger (not shown) and the photosensitive unit cleaner 14 are disposed along the direction of rotations of the photosensitive member 11Y A surface area between the charger unit 12 and a development position 16 is an irradiation area which comes under a light beam 21 from the exposure unit 20. The charger unit 12 uniformly charges up an outer peripheral surface of the photosensitive member 11Y to a predetermined surface potential Vd (Vd=DC+600V for instance) upon application of a charging bias from a charging bias generator 111, and functions as a charger.

The exposure unit 20 irradiates the light beam 21 of laser for example toward the outer peripheral surface of the photosensitive member 11Y thus uniformly charged by the charger unit 12. The exposure unit 20 exposes the photosensitive member 11Y with the light beam 21 in accordance with a control command fed from an exposure controller 112 to form on the photosensitive member 11Y a yellow electrostatic latent image which corresponds to the image signal, and functions. When a print command signal containing an image signal is fed to a CPU 101 of the main controller 100 from an external apparatus such as a host computer via an interface 102 for instance, in response to a command from the CPU 101 of the main controller 100, a CPU 113 outputs a control signal suitable to this image signal to the exposure controller 112 at predetermined timing. The exposure unit 20 irradiates the photosensitive member 11Y with the light beam 21 in accordance with a control command from the exposure controller 112, whereby a yellow electrostatic latent image which corresponds to the image signal is formed on the photosensitive member 11Y (latent image formation step). When a patch image needs be formed, the CPU 113 provides the exposure controller 112 with a control signal corresponding to a image signal which expresses a predetermined pattern (e.g., a solid image, a thin line image, a white thin line image, registration mark), and a yellow electrostatic latent image which corresponds to this pattern is formed on the photosensitive member 11Y.

The yellow electrostatic latent image formed in this manner is visualized with yellow toner which is supplied from the developer roller 31 of the developer 30Y (developing step). The yellow toner image formed on the photosensitive member 11Y is transported to a primary transfer position 42Y which is opposed against a primary transfer roller 53Y, as the photosensitive member 11Y rotates. The primary transfer roller 53Y is located such that the intermediate transfer belt 41 comes between the primary transfer roller 53Y and the photosensitive member 11Y Further, the intermediate transfer belt 41 runs across plural rollers 43*a* through 43*e*, 44, 45, and when driven by a drive motor not shown, rotates in the direction 47 (the counterclockwise direction in FIG. 1) which follows the photosensitive member 11Y at the same peripheral speed as the photosensitive member 11Y. Upon application of a primary transfer bias (which may be DC−400V, for instance) from a transfer bias generator 115, the yellow toner image on the photosensitive member 11Y is primarily transferred onto the intermediate transfer belt 41 at the primary transfer position 42Y (transfer step).

The discharger formed by an LED or the like removes residual charges remaining on the photosensitive member 11Y after the primary transfer, and the photosensitive unit cleaner 14 removes the residual liquid developer. The photosensitive unit cleaner 14 comprises a photosensitive cleaning blade 141 of rubber which abuts on the surface of the photosensitive member 11Y, and the photosensitive cleaning blade 141 scrapes off and removes the liquid developer 32 which remains on the photosensitive member 11Y after the primary transfer of the toner image onto the intermediate transfer belt 41. The structure and the operation of the developing unit 30Y will be described in detail later.

Similar structures to that for yellow (Y) are used for the other toner colors, and toner images corresponding to the image signal are formed. The toner images in the respective colors of yellow (Y), magenta (M), cyan (C) and black (K) formed on the photosensitive members 11Y, 11M, 11C and 11K are primarily transferred at the primary transfer positions 42Y, 42M, 42C and 42K which are opposed against the primary transfer rollers 53Y, 53M, 53C and 53K and consequently superimposed one atop the other on the surface of the intermediate transfer belt 41, and a full color toner image is formed.

The toner image formed on the intermediate transfer belt 41 is transported to a secondary transfer position 49 which is between rollers 45 and 48, as the intermediate transfer belt 41 rotates. The recording medium 4 stored in the paper feed cassette 3 (FIG. 1) is transported to the secondary transfer position 49 by a transportation unit 70 will be described later, in synchronization to the transportation of the primarily transferred toner image. The roller 48 rotates in the direction (the clockwise direction in FIG. 1) which follows the intermediate transfer belt 41 at the same peripheral speed as the intermediate transfer belt 41, and upon application of a secondary transfer bias from the transfer bias generator 115, the toner image on the intermediate transfer belt 41 is secondarily transferred onto the recording medium 4. The roller 48 may be of urethane rubber whose hardness is about 50 in JIS-A scale and may have a diameter of about 25 mm. Since this embodiment achieves transfer using the rollers, a transfer condition may be set through constant voltage control or constant current control. Corona discharge may be used for transfer instead of using the rollers, in which case the output of corona discharge may be controlled to set a transfer condition. A cleaning blade 51 removes the residual liquid developer on the intermediate transfer belt 41 after the secondary transfer.

The recording medium 4 now seating the secondarily transferred toner image is transported along a predetermined transportation path 5 (denoted at the chain line in FIG. 1), and a fixing unit 60 fixes the toner image on the recording medium 4 which will then be discharged to a discharge tray which is disposed in an upper portion of the main apparatus section 2. The fixing unit 60 comprises a heat roller 61 equipped with a built-in heater 61*h* and a press roller 62 which contacts the heat roller 61. As a heater controller 116 controls activation of the heater 61*h*, a fixing temperature in the fixing unit 60 is adjusted to any desired temperature.

In this embodiment, the image forming apparatus further comprises the transportation unit 70 which transports the recording medium 4 along the predetermined transportation path 5. In the transportation unit 70, as shown in FIG. 1, a paper feed roller 71 is disposed for the paper feed cassette 3. With the paper feed roller 71, one recording medium 4 is retrieved at a time from the paper feed cassette 3 and transported to a feed roller 72. The feed roller 72 then transports the recording medium 4 to a gate roller 73, and the recording medium 4 is temporarily held stand-by at the position of the gate roller. The gate roller 73 is driven at timing for the secondary transfer operation described above, and feeds the recording medium 4 to the secondary transfer position 49. Disposed for the discharge tray are a pre-discharge roller 74, a discharge roller 75 and an inverting roller 76. The recording medium 4 as it is after the secondary transfer is transported to the discharge tray via the fixing unit 60, the pre-discharge roller 74 and the discharge roller 75.

The discharge roller 75 is capable of rotating forward and backward, noting the necessity of inverting the recording medium 4 and transporting the recording medium 4 back to the gate roller 73 again for double-side printing. In other words, when the recording medium 4 is to be discharged straight to the discharge tray, the discharge roller 75 keeps rotating forward and transports the recording medium 4 to the discharge tray completely. On the contrary, when inversion and re-feeding is needed, upon arrival of the rear end of the recording medium 4 at a predetermined position between the pre-discharge roller 74 and the discharge roller 75, the discharge roller 75 rotates backward and sends the recording medium 4 to the inverting roller 76. This transports the recording medium 4 back to a re-feed intermediate roller 77 along an inversion path 5*a*. The re-feed intermediate roller 77 and a re-feed pre-gate roller 78 transport the recording medium 4 to the gate roller 73, and the recording medium 4 is temporarily held stand-by at the position of the gate roller. The recording medium 4 is inverted and re-fed in this fashion. At this stage, the surface of the recording medium 4 which abuts on the intermediate transfer belt 71 and receives the transferred image is the opposite surface to the surface which has already received the earlier transferred image. The images are thus formed on the both surfaces of the recording medium 4. The surface of the recording medium 4 which has already received the earlier transferred image touches the roller 48 during the secondary transfer on the opposite surface, and toner not completely fixed to the recording medium 4 may adhere to the roller 48. A cleaning blade 52 removes the toner adhering to the roller 48 in this manner.

In FIG. 3, the main controller 100 comprises an image memory 103 which stores the image signal fed from an external apparatus via the interface 102. Receiving the print command signal containing the image signal from the external apparatus via the interface 102, the CPU 101 converts the print command signal into job data in a suitable format to instruct the engine part 1 to operate and sends the job data to the engine controller 110.

A memory 117 of the engine controller 110 is formed by a ROM which stores a control program for the CPU 113 including preset fixed data, a RAM which temporarily stores control data for the engine part 1, a computation result derived by the CPU 113, etc. The CPU 113 stores in the memory 117 data regarding the image signal sent from the external apparatus via the CPU 101.

Figure 4:
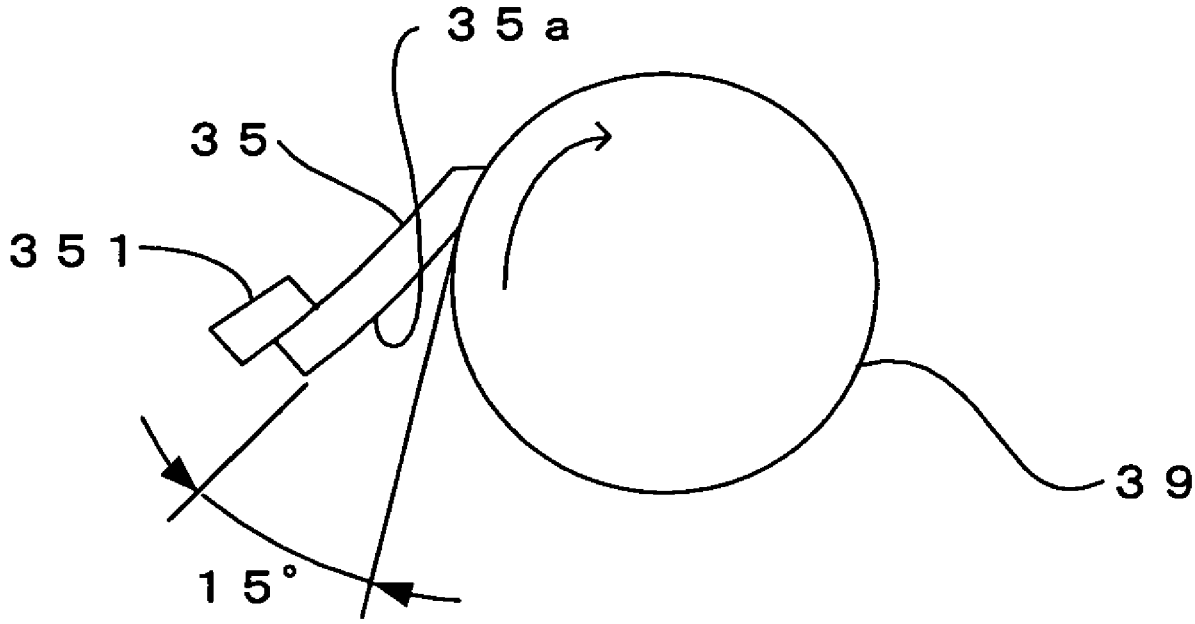
FIG. 4 is an essential enlarged view of FIG. 2.
Figure 5:
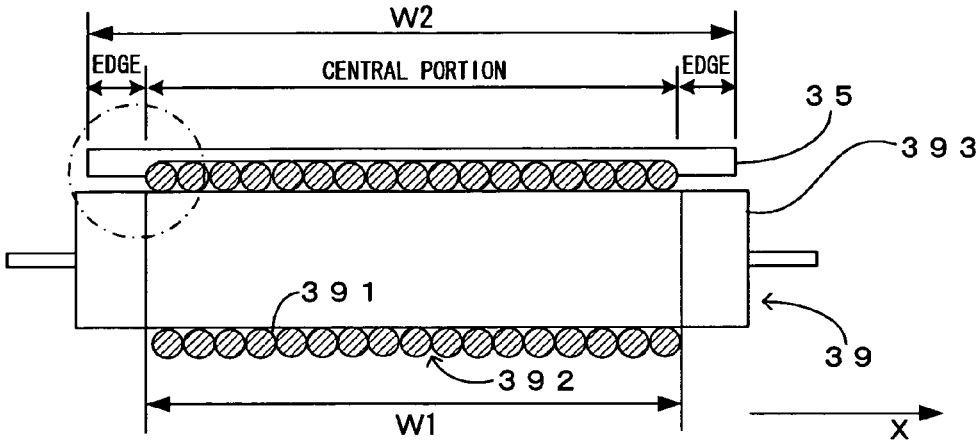
FIG. 5 is an enlarged schematic drawing of a wire bar and a regulator blade.
Figure 6:
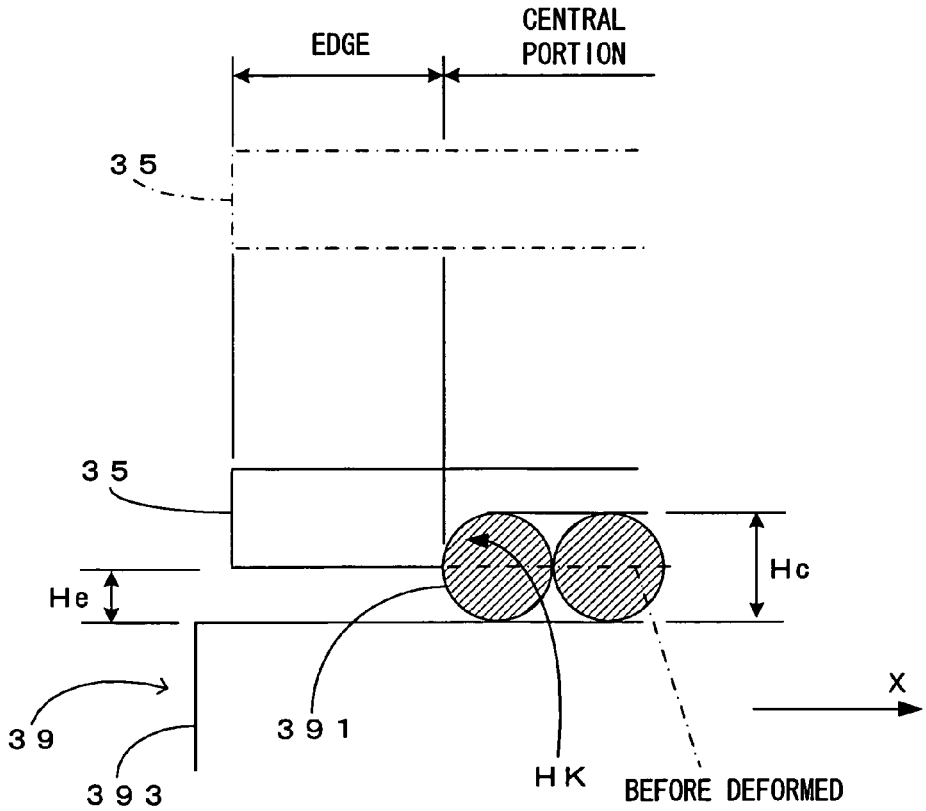
FIG. 6 is an enlarged drawing of the portion enclosed by the chain line in FIG. 5.
Figure 7:
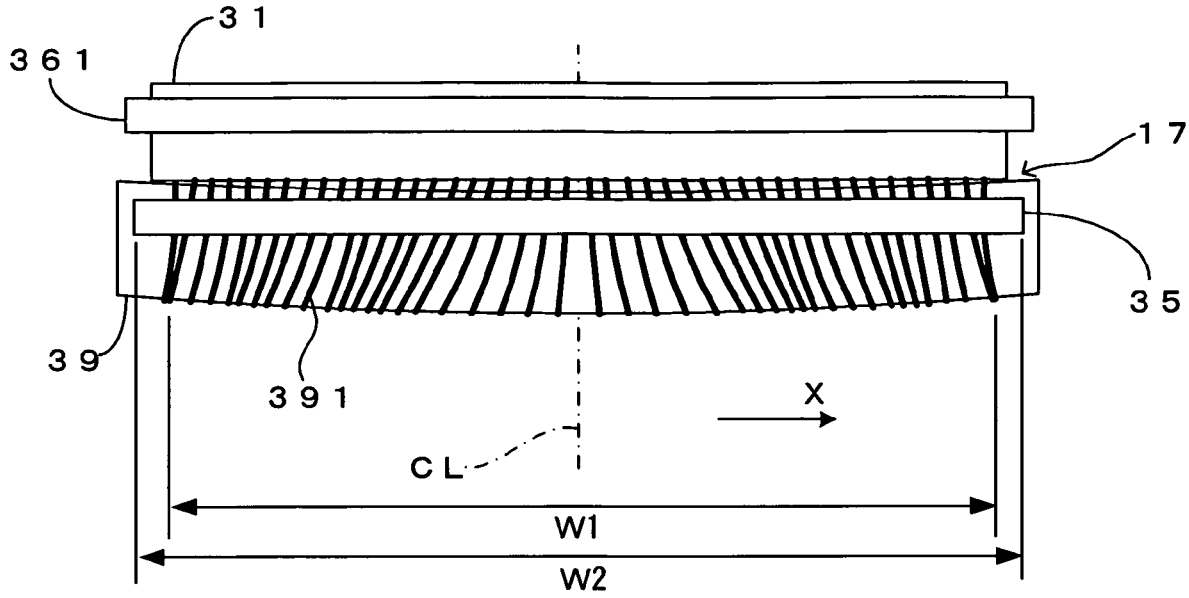
FIG. 7 is a conceptual view of the wire bar and the developer roller.

The structure and the operation of the developing unit 30Y will now be described in detail with reference to FIGS. 2, 4 through 7. FIG. 4 is an essential enlarged view of FIG. 2, FIG. 5 is an enlarged schematic drawing of a wire bar and a regulator blade, FIG. 6 is an enlarged drawing of the portion enclosed by the chain line in FIG. 5, and FIG. 7 is a conceptual view of the wire bar and the developer roller. The structures of the developing unit 30M, 30C and 30K are similar to the structure of the developer 30Y, and therefore will be denoted at the same or corresponding reference symbols but will not be described.

The developing unit 30Y comprises, in addition to the developer roller 31 (which corresponds to the "developing agent carrier" of the invention), the tank 33Y which stores the liquid developer 32 in which yellow toner is dispersed (which corresponds to the "developing agent housing part" of the invention), an agitating roller 37 which agitates the liquid developer 32 held in the tank 33Y, a wire bar 39 which scoops up the liquid developer 32 and applies the liquid developer 32 to the developer roller 31, a regulator blade 35 (which corresponds to the "regulator member" of the invention) which restricts the amount of the liquid developer on the wire bar 39, and a developer roller cleaner 36 which removes the liquid developer remaining on the developer roller 31 after the toner has been supplied to the photosensitive member 11Y The developer roller 31 rotates in the direction (the counterclockwise direction in FIG. 2) which follows the photosensitive member 11Y approximately at the same peripheral speed as the photosensitive member 11Y Meanwhile, the wire bar 39 rotates in the direction (the clockwise direction in FIG. 2) D2 which follows the developer roller 31 approximately at the same peripheral speed as the developer roller 31.

In this embodiment, the liquid developer 32 (which corresponds to the "liquid" and the "liquid developing agent" of the invention) is obtained by dispersing, in a carrier liquid, toner formed by a coloring pigment whose average particle diameter is from about 0.1 to about 5 μm, a binder of an epoxy resin or the like which bonds the coloring pigment, an electric charge control agent which provides a predetermined electric charge to toner, a dispersing agent which uniformly disperses the coloring pigment, etc. This embodiment uses silicon oil such as polydimethylsiloxane oil for instance as the carrier liquid and sets the toner density to 5 through 40 wt % which is higher than that of a low-density liquid developer (having the toner density of 1 through 2 wt %) which is popular for liquid development methods. The type of the carrier liquid is not limited to silicon oil, and ISOPAR L (trade name) manufactured by EXXON CHEMICAL JAPAN or paraffin oil may be used for instance. The viscosity of the liquid developer 32, which is determined by the materials of the carrier liquid, the toner and the toner density, etc., is set to 100 through 10000 mPa·s for instance in this embodiment.

The gap between the photosensitive member 11Y and the developer roller 31 (namely, a development gap=the thickness of a layer of the liquid developer) is set to 5 through 40 μm for instance in this embodiment, and the development nip distance (which is a distance along the peripheral direction over which the liquid developer layer contacts both the photosensitive member 11Y and the developer roller 31) is set to 5 mm for example in this embodiment. While a development gap of 100 to 200 μm is necessary to secure the bulk of toner where a low-density liquid developer like the one mentioned above is used, the development gap is short in this embodiment because of the high-density liquid developer. This shortens a distance which the toner moves in the liquid developer due to electrophoresis, and further, since a stronger electric field develops even at the same developing bias, more efficient and faster development is attained.

The agitating roller 37 scoops up the liquid developer 32 which is held in the tank 33Y, and transports the same to the wire bar 39. A lower portion of the agitating roller 37 is dipped in the liquid developer 32 which is held in the tank 33Y, and the agitating roller 37 is away from the wire bar 39 over a distance of about 1 mm. The agitating roller 37 is capable of rotating about its central axis which is located below the central axis of rotations of the wire bar 39. The agitating roller 37 rotates in the same direction as the direction of rotations D2 (the clockwise direction in FIG. 2) of the wire bar 39. Besides the function of scooping up the liquid developer 32 which is held in the tank 33Y and transporting the same to the wire bar 39, the agitating roller 37 also has a function of agitating the liquid developer 32 so that the liquid developer 32 is kept in a proper condition. A metallic roller of iron for instance having a diameter of about 20 mm may be used as this agitating roller.

At a coating position 17, the wire bar 39 supplies to the developer roller 31 the liquid developer 32 which has been transported from the tank 33Y by the agitating roller 37. The wire bar 39 is obtained by winding a wire 391 around a metal core 393 (which corresponds to the "rod-like member" of the invention) of iron or other metal in a coating area which is in a central portion of the metal core 393 as shown in the schematic drawing in FIG. 5. The width of the coating area of the wire bar 39 is W1 along the X-direction (which corresponds to the "longitudinal direction" of the invention as shown in FIGS. 5 and 6) which is approximately orthogonal to the direction of rotations D2. Contacting the liquid developer 32 while rotating clockwise, the wire bar 39 carries the liquid developer 32 in its carrying portions 392, which are formed between the wire sections of the wire 391 as the wire 391 is wound around the metal core, and transports thus carried liquid developer 32 to the developer roller 31. The wire bar 39 is therefore capable of applying the liquid developer 32 to the developer roller 31 at the coating position 17 over the width W1 along the X-direction (the width of the coating area taken along the X-direction)in which there are the carrying portions 392 between the wire sections of the wire 391.

For instance, the wire bar 39 may be obtained by winding the wire 391 of stainless steel (SUS304) having a wire diameter of 100 μm around the metal core 393, which may be a rod-like member of steel, within the coating area which is in the central portion of the metal core 393 in such a manner that the wire 391 is tightly wound in the intervals of 100 μm. Where the length W3 of the metal core 393 is 313 mm for example, the width W1 of the coating area which is in the central portion of the metal core 393 may be 300 mm. In this case, within ranges over 6.5 mm at the both ends, there are fixing/processing parts which fixedly solder the wire 391 at the start and the end of winding. In this manner, the friction force caused by the winding around the metal core 393 and the fixing force created by the soldering in the fixing/processing parts at the both ends fix the wire 391 to the metal core 393, which permits winding of the wire 391 around the metal core 393 such that the outer diameter of the wire bar 39 as it is after winding of the wire 391 is 25 mm for instance.

For proper application of the liquid developer 32 carried on the wire bar 39 to the developer roller 31, the surface of the wire bar 39 contacts under pressure a layer of an elastic member of the developer roller 31 which will be described later. The wire bar 39 is capable of rotating about its central axis which is located below the central axis of rotations of the developer roller 31. The wire bar 39 rotates in the opposite direction D2 (the clockwise direction in FIG. 2) to the direction of rotations (the counterclockwise direction in FIG. 2) of the developer roller 31.

The regulator blade 35 contacts at its belly the surface of the wire bar 39 and restricts the amount of the liquid developer 32 on the wire bar 39, on the upstream side to the coating position 17 along the direction of rotations D2 of the wire bar 39. In short, the regulator blade 35 scrapes off an excessive amount of the liquid developer 32 on the wire bar 39 and measures the amount of the liquid developer 32 on the wire bar 39 to be supplied to the developer roller 31, and the width of the regulator blade 35 along the X-direction is W2. The regulator blade 35 is made of urethane rubber which serves as an elastic member (whose modulus of elasticity is about 50 kg/cm$^2$ (100%)), and a regulator blade support member 351 of iron or other metal supports blade-shaped urethane rubber having a thickness of about 1.6 mm in the regulator blade 35. The rubber hardness of the regulator blade 35 is about 77 about on the JIS-A scale, and the hardness (approximately 77 degrees) of the regulator blade 35 in the abutting portion where the regulator blade 35 abuts on the surface of the wire bar 39 is lower than the hardness (approximately 85 degrees) of the elastic member layer of the developer roller 31 which will be described later in the pressure-contact portion where the developer roller 31 is in contact under pressure with the surface of the wire bar 39. In this embodiment, the regulator blade 35 is disposed such that its front tip is directed toward the downstream side along the direction of rotations of the wire bar 39, for the purpose of so-called trail regulation. As shown in FIG. 4, where the contact angle is defined as the angle between the tangent line to an outer peripheral surface of the wire bar 39 and a belly portion 35*a* of the regulator blade 35 at the contact position that the regulator blade 35 and the wire bar 39 contact, the support member 351 supports the regulator blade 35 such that the contact angle is 15 degrees in this embodiment. The width W2 of such a regulator blade may be 310 mm for instance. The contact portion between the regulator blade 35 and the wire bar 39 and other features will be described later in detail.

To develop the electrostatic latent image carried on the photosensitive member 11Y with the liquid developer 32, the developer roller 31 carries and transports the liquid developer 32 to the development position 16 which is opposed against the photosensitive member 11Y The developer roller 31 comprises, at the outer peripheral surface of the metallic inner core of iron or the like, the elastic member layer which is one example of the conductive elastic member, and the diameter of the elastic member layer is about 20 mm. The elastic member layer has a double-layer structure in which the inner layer is of urethane rubber whose hardness is about 30 degrees on the JIS-A scale and whose thickness is about 5 mm and the surface layer (outer layer) is of urethane rubber whose hardness is about 85 degrees on the JIS-A scale and whose thickness is about 30 μm. The surface layer of the developer roller 31 serves as the pressure-contact portion in which the developer roller 31 contacts under pressure, as it is elastically deformed, the wire bar 39 and the photosensitive member 11Y.

The developer roller 31 is capable of rotating about its central axis which is located below the central axis of rotations of the photosensitive member 11Y. The developer roller 31 rotates in the opposite direction (the counterclockwise direction in FIG. 2) to the direction of rotations D1 of the photosensitive member 11Y During development of the electrostatic latent image formed on the photosensitive member 11Y, an electric field is created between the developer roller 31 and the photosensitive member 11Y.

The developer roller cleaner 36 comprises a developer roller cleaning blade 361 of rubber which abuts on the surface of the developer roller 31, along the direction of thrust (rotation axes) of the developer roller 31, on the downstream side to the development position 16 along the direction of rotations (the counterclockwise direction) of the developer roller 31. The developer roller cleaner 36 is a device which scrapes off, with its developer roller cleaning blade 361, the liquid developer 32 which remains on the developer roller 31 after development at the development position 16.

In this embodiment, the axis-to-axis distance between the rotation axes of the wire bar 39 and those of the developer roller 31 is shorter than the sum of the radius of the wire bar and that of the developer roller so as to favorably move the liquid developer 32 from the wire bar 39 to the developer roller 31. Where the diameter of the wire bar 39 is 25 mm and that of the developer roller 31 is 20 mm as described above, the axis-to-axis distance between the rotation axes of the wire bar 39 and those of the developer roller 31 may be 22.4 mm for instance.

In the developing unit 30Y having this structure, as the agitating roller 37 rotates about its central axis, the liquid developer 32 which is held in the tank 33Y is scooped up and transported to the wire bar 39. The liquid developer 32 transported to the wire bar 39 reaches the contact position with the regulator blade 35, as the wire bar 39 rotates. While the liquid developer 32 moves passed the contact position, the regulator blade 35 scrapes off an excessive amount of the liquid developer 32, and the amount of the liquid developer 32 to be supplied to the developer roller 31 is consequently measured. In other words, owing to the carrying portions 392 in the wire bar 39 described above, the regulator blade 35 abutting on the wire bar 39 scrapes the liquid developer 32 off from the wire bar 39 except for the liquid developer 32 carried in the carrying portions 392. Further, since the diameter and the winding of the wire 391 are determined so that a proper amount of the liquid developer 32 will be supplied to the developer roller 31, when the regulator blade 35 scrapes off the liquid developer 32 which is on the wire bar 39, the liquid developer 32 measured by the carrying portions 392 to a proper amount is left in the carrying portions 392.

The wire bar 39 scoops up the liquid developer 32 which is held in the tank 33Y in this manner, the regulator blade 35 restricts the amount of the liquid developer 32 on the wire bar 39 to the constant amount, the constant liquid developer 32 is applied to the surface of the developer roller 31 at the coating position 17, and as the developer roller 31 rotates, the liquid developer 32 is transported to the development position 16 which is opposed against the photosensitive member 11Y. The toner inside the liquid developer 32 is positively charged for instance, due to the function of the electric charge control agent or the like. At the development position 16, the liquid developer 32 carried on the developer roller 31 is supplied from the developer roller 31 to and adheres to the photosensitive member 11Y, and a developing bias Vb (Vb=DC+400V for example) applied upon the developer roller 31 from a developing bias generator 114 moves the yellow toner from the developer roller 31 to the photosensitive member 11Y and the yellow electrostatic latent image is visualized. The liquid developer left on the developer roller 31 without adhering to the photosensitive member 11Y is scraped off by the developer roller cleaning blade 361.

The yellow toner image thus formed on the photosensitive member 11Y is primarily transferred onto the intermediate transfer belt 41 at the primary transfer position 42Y as described earlier, and the photosensitive unit cleaner 14 removes the residual liquid developer 32 remaining on the photosensitive member 11Y after the primary transfer.

A detailed description will now be given, with reference to FIGS. 4 through 7, on where the developer roller 31, the regulator blade 35 and the wire bar 39 are disposed relative to each other along the X-direction (the longitudinal direction). In this embodiment, the developer roller 31, the regulator blade 35 and the wire bar 39 are disposed so that approximately central sections of the widths W1 and W2 of the coating area of the developer roller 31 (the portion where the wire 391 is wound) and the regulator blade 35 taken along the X-direction described above are on one straight line CL, as shown in FIG. 7.

Further, in this embodiment, the width W2 of the regulator blade 35 is longer than the width W1 of the coating area (the portion bearing the wound wire 391) along the X-direction, the central portion of the regulator blade 35 contacts the wire 391, and the respective ends of the regulator blade 35 are located on the outer side to the coating area. In addition, the central portion of the regulator blade 35 (the contact portion with the wire 391), which is the elastic member of urethane rubber, is compressed and deformed when contacting the wire 391 (FIGS. 5 and 6). Hence, the gap He between the respective ends of the regulator blade 35 and the surface of the metal core 393 is shorter than the gap Hc between the central portion of the regulator blade 35 and the surface of the metal core 393, and steps HK are formed at the boundaries between the central portion and the respective ends of the regulator blade 35. As the steps HK fit with the both ends of the wire body along the X-direction (the both ends of the coating area) which is formed by winding the wire 391 around the coating area of the wire bar 39, the regulator blade 35 presses the wire body as if to wrap the wire body.

The effect brought about by the wire bar 39 and the regulator blade 35 having the structures above will now be described in detail with reference to FIG. 7. First, as the agitating roller 37 rotates, the carrying portions 392, which are formed between the wire sections of the wire 391 in the surface of the wire bar 39, carry the liquid developer 32 which has been transported to the wire bar 39, transport the liquid developer 32 to the coating position 17 and apply the liquid developer 32 to the developer roller 31. In relation to this, the axis-to-axis distance between the rotation axes of the wire bar 39 and those of the developer roller 31 is set shorter than the sum of the radius of the wire bar and that of the developer roller as described above, in an attempt to favorably move the liquid developer 32 from the wire bar 39 to the developer roller 31. This could cause the following problem. That is, the pressure developing in the contact portion (the coating position 17) between the wire bar 39 and the developer roller 31 could bend the wire bar 39 by about scores of μm, and the wire 391 could loosen along the direction of the rotations axes (X-direction) of the wire bar 39 or fall off (FIG. 7).

In this embodiment however, as shown in FIGS. 5 and 6, the regulator blade 35 is disposed with the steps HK, which are created as the regulator blade 35 is compressed and deformed, fit with the both ends of the wire body along the X-direction (the both ends of the coating area) which is formed by winding the wire 391 around the coating area of the wire bar 39. In short, the regulator blade 35 presses the wire body as if to wrap the wire body with the steps HK which are created in the regulator blade. Hence, loosening of the wire 391 caused by distortion of the wore bar 39 is corrected when the steps HK of the regulator blade 35 press the wire body as if to wrap the wire body, and the former state is regained before the wire 391 contacts the developer roller 31 at the coating position 17 (FIG. 7).

As described above, in this embodiment, the central portion of the regulator blade 35 contacts the wire 391 of the wire bar 39 along the X-direction, and the respective ends of the regulator blade 35 are disposed on the outer side to the coating area (the portion bearing the wound wire 391). Further, with the regulator blade 35 in contact with the wire 391, the gap He between the respective ends of the regulator blade 35 and the surface of the metal core 393 (rod-like member) is shorter than the gap Hc between the central portion of the regulator blade 35 and the surface of the metal core 393, and the steps HK are formed at the boundaries between the central portion and the respective ends of the regulator blade 35. Hence, along the X-direction, it is possible to press, with the regulator blade 35, the central portion and the respective ends of the wire body which is wound around the coating area. As the wire body including the both ends of the same is pressed, it is therefore possible to prevent loosening of the wire 391 wound around the metal core 393. In addition, the steps HK formed at the boundaries between the central portion and the respective ends of the regulator blade 35 respectively fit with the both ends of the wire body which is wound around the coating area, and the steps HK press the wire body as if to wrap the wire body at the both ends of the wire body along the X-direction. Hence, even when the wire 391 wound around the coating area gets deviated, the regulator blade 35 located on the upstream side to the coating position 17 fits, at its steps HK, with the both ends of the wire body and presses the wire body as if to wrap the both ends of the wire body, thereby eliminating the deviation back to the original state. The regulator blade 35 thus corrects the deviation of the wire before the wire 391 contacts the developer roller 31 at the coating position 17, and therefore, the wire bar 39 contacts the developer roller 31 at the coating position 17 always in a favorable state. This realizes stable and uniform application of the liquid developer 32 to the developer roller 31 over the entire image width along the X-direction.

Further, in this embodiment, the regulator blade 35 is made of urethane rubber which serves as the elastic member, and as the regulator blade 35 contacts the wire 391, the central portion of the regulator blade 35 is compressed and deformed and the steps HK are created. Since the wire 391 is pressed by the pressing force which is created by contacting of the regulator blade 35 with the wire 391 and additionally by the elastic force of urethane rubber (elastic member), it is possible to more efficiently prevent loosening of the wire 391 and make the wire bar 39 contact the developer roller 31 at the coating position 17 always in a favorable state.

Further, in this embodiment, the regulator blade 35 contacts, at its belly 35*a*, the wire bar 39. Since this achieves pressing of the wire bar 39 with the belly (surface) 35*a* of the regulator blade 35, it is possible to efficiently transmit this pressing force to a wide area of the wire sections of the wire 391 (coating area) of the wire bar 39. This even more efficiently prevents loosening of the wire 391 and contacts the wire bar 39 with the developer roller 31 at the coating position 17 always in a favorable state.

Second Embodiment

Figure 8:
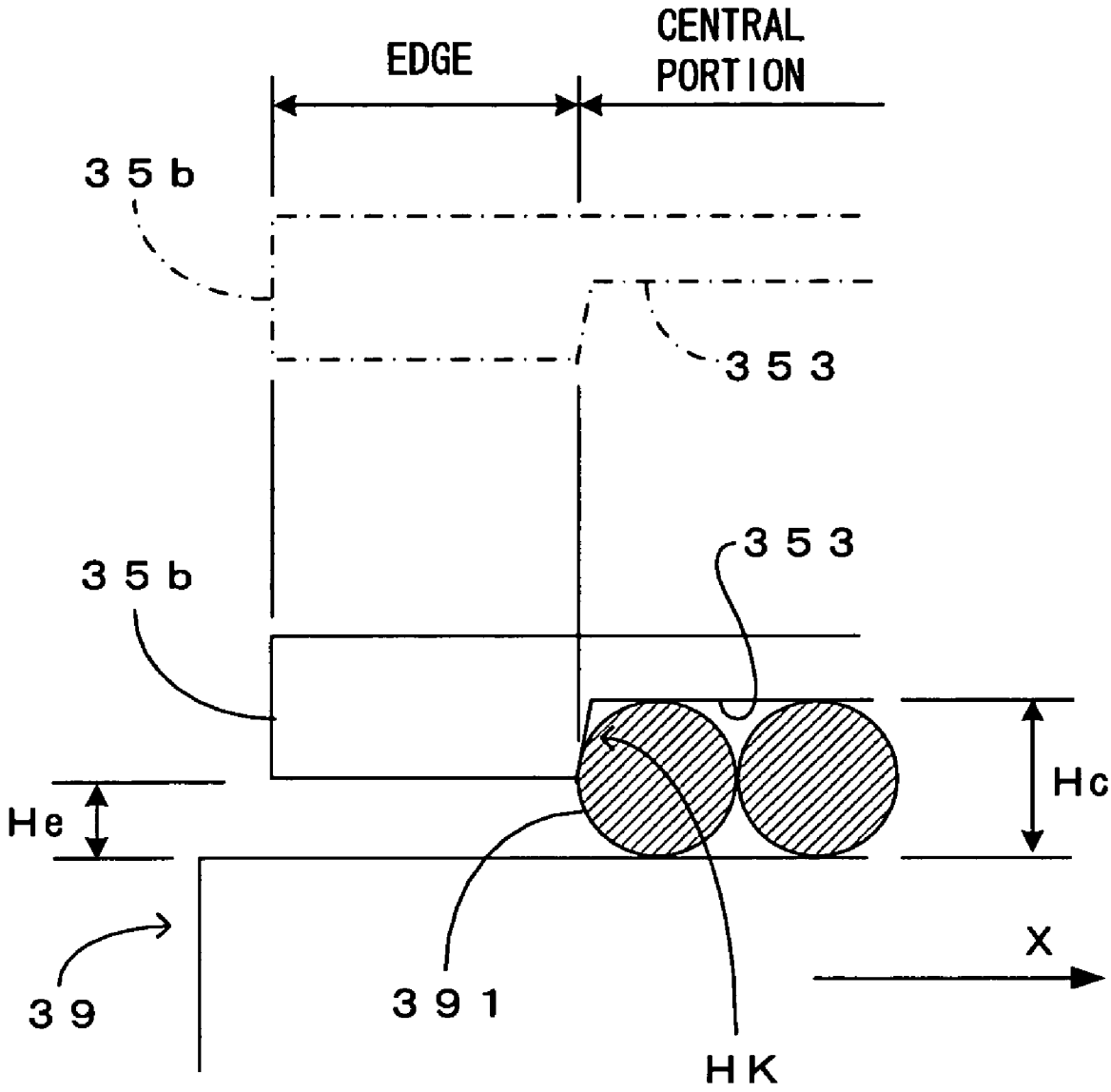
FIG. 8 is an enlarged schematic diagram of a wire bar and a regulator blade in the second embodiment.

FIG. 8 is an enlarged schematic diagram of a wire bar and a regulator blade in the second embodiment of the image forming apparatus according to the invention. A major difference of the second embodiment from the first embodiment is that concaves 353 corresponding to the coating area are formed in a central portion of a regulator blade 35*b*, and other structures are similar to those in the first embodiment. The second embodiment will now be described in detail, focusing mainly on the difference from the first embodiment. The structures and the operations which are the same as those according to the first embodiment will not be described.

The regulator blade 35*b* according to the second embodiment is made of urethane rubber which serves as an elastic member. There are the concaves 353 in the central portion of the regulator blade 35*b* and there are steps HK at the boundaries between the ends and the central portion of the regulator blade 35*b*. The regulator blade 35*b* is disposed such that the inner bottom surfaces of the concaves 353 contact the surface of the wire 391. Combined with the elastic force of urethane rubber, this presses the wire 391 wound around the coating area of the wire bar 39 as if to wrap the wire 391 in the concaves 353 which are formed in the regulator blade 35*b*. It is therefore possible to even more efficiently prevent loosening of the wire 391 and make the wire bar 39 contact the developer roller 31 at the coating position 17 always in a favorable state.

Third Embodiment

Figure 9:
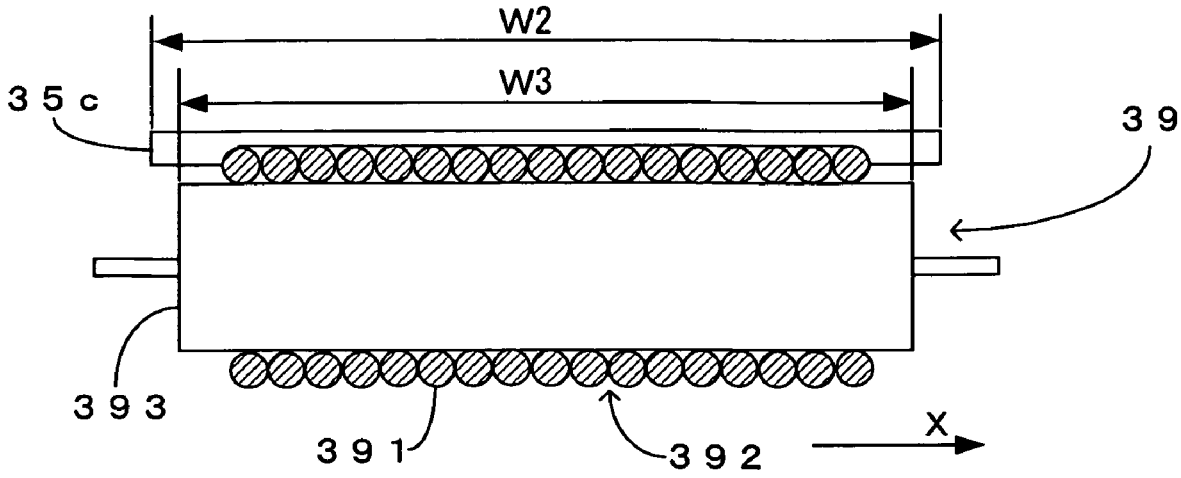
FIG. 9 is an enlarged schematic diagram of a wire bar and a regulator blade in the third embodiment.

FIG. 9 is an enlarged schematic diagram of a wire bar and a regulator blade in the third embodiment of the image forming apparatus according to the invention. A major difference of the third embodiment from the first embodiment is that the width W2 of a regulator blade 35*c* is wider than the width W3 of the wire bar 39, and other structures are similar to those in the first embodiment. The third embodiment will now be described in detail, focusing mainly on the difference from the first embodiment. The structures and the operations which are the same as those according to the first embodiment will not be described.

In the third embodiment, along the X-direction, the width W2 of the regulator blade 35*c* is wider than the width W3 of the wire bar 39 (metal core 393), and the both edges of the regulator blade 35*c* are respectively located on the outer side to the both edges of the wire bar 39 (metal core 393). Since the both edges of the regulator blade 35 are respectively located on the outer side to the both edges of the wire bar 39 along the X-direction, it is possible to prevent the centrifugal force created by rotations of the wire bar 39 from blowing up the liquid developer 32 which has built up at the edge surfaces of the wire bar 39 (metal core 393) to the developer roller 31. This prevents uneven application of the blown-up liquid developer 32 to the developer roller 31. The width W2 of the regulator blade 35*c* having such a structure may be 316 mm for instance.

Fourth Embodiment

Figure 10:
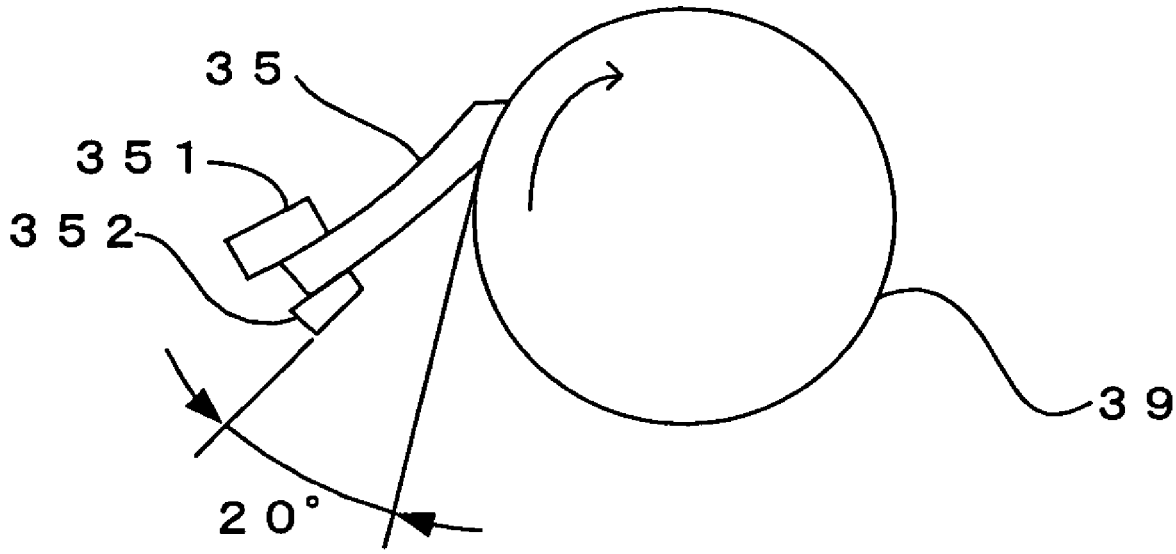
FIG. 10 is an essential enlarged view of the fourth embodiment.

FIG. 10 is an essential enlarged view of the fourth embodiment of the image forming apparatus according to the invention. A major difference of the fourth embodiment from the first through the third embodiments is that the support member 351 which supports the regulator blade further comprises an adjust member 352. Other structures are similar to those in the first through the third embodiments. The fourth embodiment will now be described in detail, focusing mainly on the difference from the first through the third embodiments. The structures and the operations which are the same as those according to the first through the third embodiments will not be described.

In the fourth embodiment, the support member 351 which supports the regulator blade 35 further comprises the adjust member 352. Where the contact angle is defined as the angle between the tangent line to the outer peripheral surface of the wire bar 39 and the regulator blade 35 at the contact position that the regulator blade 35 and the wire bar 39 contact, it is possible to adjust the contact angle to any desired angle within the range from 0 to 45 degrees by adjusting the adjust member 352 of the support member 351. In this embodiment, the adjust member 352 is adjusted such that the contact angle is about 20 degrees.

In this structure, adjustment of the contact angle bends the regulator blade 35 to any desired extent, which attains any desired adjustment of the elastic force of the regulator blade 35. It is therefore possible to freely adjust the force with which the regulator blade 35 presses the wire bar 39. Hence, it is possible to freely adjust the pressing force of the regulator blade 35 upon the wire bar 39 in accordance with the structure of the wire bar 39 and that of the regulator blade 35 (elastic force, etc.). As the pressing force of the regulator blade 35 upon the wire bar 39 is adjusted in accordance with the structures of the wire bar 39 and the regulator blade 35, it is possible to efficiently prevent loosening of the wire 391 and make the wire bar 39 contact the developer roller 31 at the coating position 17 always in a favorable state. Further, as the pressing force of the regulator blade 35 upon the wire bar 39 is adjusted to desired force, it is possible to more efficiently regulate (scrape off) the liquid developer 32 which is carried by the wire bar 39. Still further, in this embodiment, since the belly 35*a* of the regulator blade 35 contacts the wire bar 39, it is possible to more efficiently regulate (scrape off) the liquid developer 32 which is carried on the wire bar 39.

Fifth Embodiment

Figure 11:
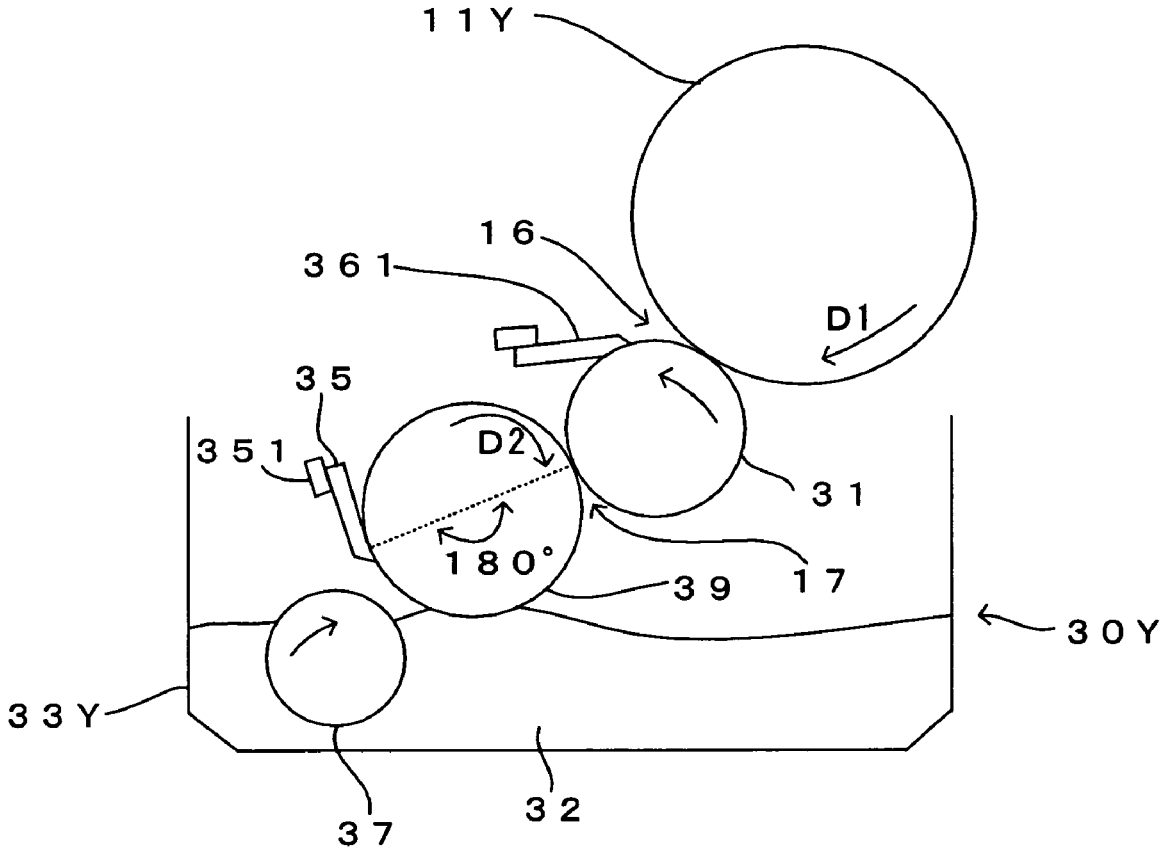
FIG. 11 is an essential enlarged view of the fifth embodiment.

FIG. 11 is an essential enlarged view of the fifth embodiment of the image forming apparatus according to the invention. A major difference of the fifth embodiment from the first through the fourth embodiments is that the regulator blade contacts the wire bar 39 at a position which is about 180 degrees from the coating position 17 about the center of rotations of the wire bar 39. Further, the regulator blade 35 is disposed such that its front tip is directed toward the upstream side along the direction of rotations of the wire bar 39, for the purpose of so-called counter regulation. Other structures are similar to those in the first through the fourth embodiments. The fifth embodiment will now be described in detail, focusing mainly on the difference from the first through the fourth embodiments. The structures and the operations which are the same as those according to the first through the fourth embodiments will not be described.

Figure 12:
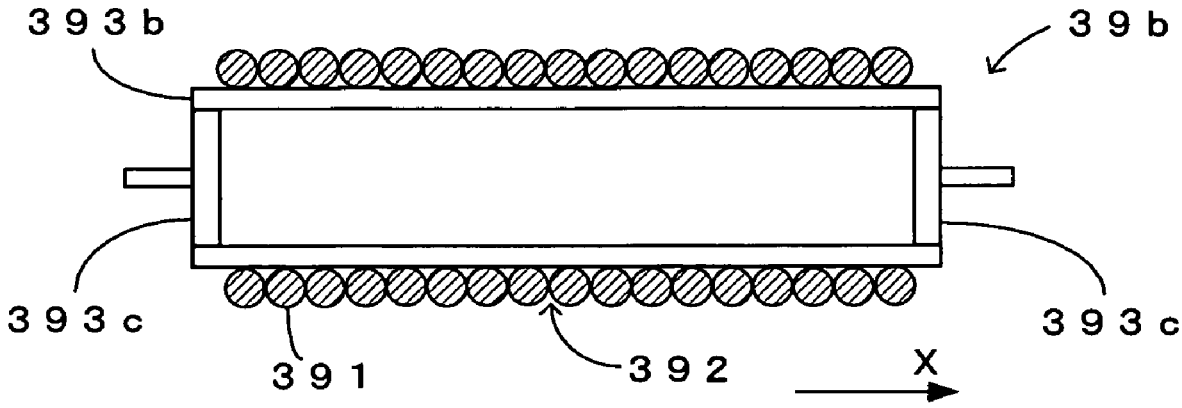
FIG. 12 is an enlarged schematic diagram of a wire bar in the sixth embodiment.

In the fifth embodiment, to contact the regulator blade 35 with the wire bar 39 at a position which is about 180 degrees from the coating position 17 about the center of rotations of the wire bar 39, the positions at which the photosensitive member 11Y and the developer roller 31 are disposed are adjusted as shown in FIG. 12. In this structure, at the coating position 17, the direction in which the force making the wire bar 39 abut on the developer roller 31 acts is approximately on one linear line with the direction in which the regulator blade 35 presses the wire bar 39. In other words, it is possible to hold the wire bar 39 between the developer roller 31 and the regulator blade 35. Since the wire bar 39 is sandwiched between the developer roller 31 and the regulator blade 35, it is possible to prevent deformation and distortion of the wire bar 39. It is possible to efficiently prevent loosening of the wire 391 wound around the rod-like member (metal core) which is attributable to distortion of the wire bar 39, and hence, to contact the wire bar 39 with the developer roller 31 at the coating position 17 always in a favorable state.

Sixth Embodiment

FIG. 12 is an enlarged schematic diagram of a wire bar in the sixth embodiment of the image forming apparatus according to the invention. A major difference of the sixth embodiment from the first through the fifth embodiments is that the rod-like member of the wire bar 39*b* is formed by a hollow metal core 393*b*. Other structures are similar to those in the first through the fifth embodiments. The sixth embodiment will now be described in detail, focusing mainly on the difference from the first through the fifth embodiments. The structures and the operations which are the same as those according to the first through the fifth embodiments will not be described.

In the sixth embodiment, the rod-like member of the invention is formed by the hollow metal core 393*b* in the invention. Further, there are flanges 393*c* having rotation axes are disposed at the both ends. Since the rod-like member is hollow, the weight of the apparatus is reduced. The outer diameter of the hollow metal core 393*b* may be about 25 mm and the inner diameter of the hollow metal core 393*b* may be about 20 mm, for instance.

Further, where the rod-like member is the hollow metal core 393*b*, while the weight of the apparatus is reduced, the strength of the hollow metal core 393*b* is inferior to that of the metal core 393. Therefore, use of a similar structure to those according to the embodiments above causes a problem that the hollow metal core 393*b* is more likely to be distorted than the metal core 393. However, as described above, since the regulator blade presses the wire 391 which is wound around the coating area of the hollow metal core 393*b* as if to wrap the wire 391, it is possible to prevent loosening of the wire 391 which is attributable to distortion of the hollow metal core 393*b*. Hence, it is possible to contact the wire bar 39*b* with the developer roller 31 at the coating position 17 always in a favorable state.

Seventh Embodiment

Figure 13:
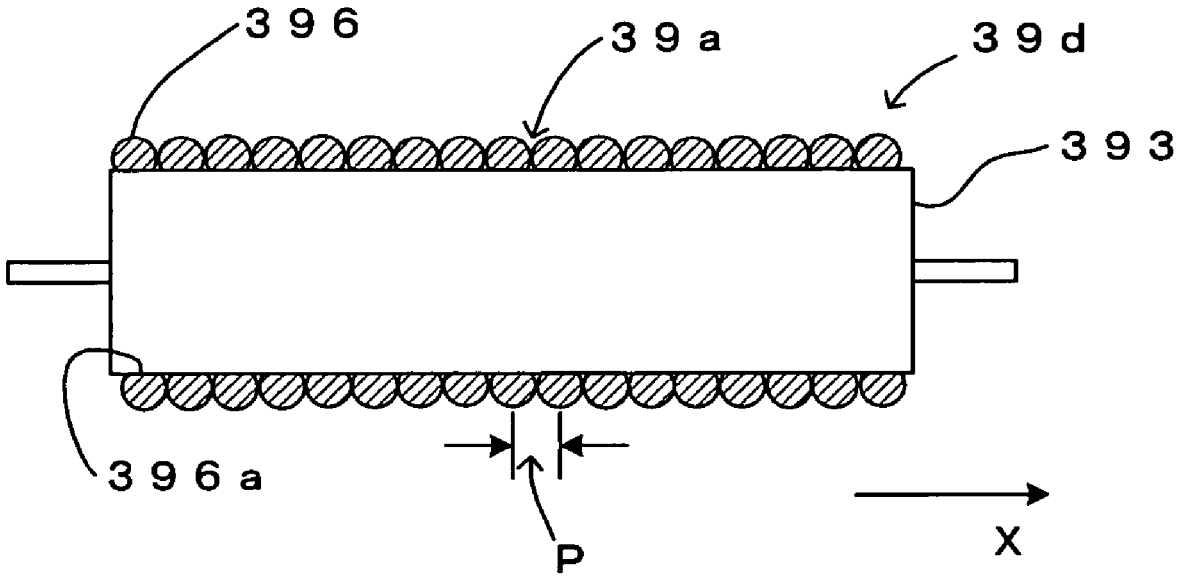
FIG. 13 is an enlarged schematic diagram of a wire bar in the seventh embodiment.

FIG. 13 is an enlarged schematic diagram of a wire bar in the sixth embodiment according to the invention. A major difference of the seventh embodiment from the first through the fifth embodiments is that a wire bar 39*d* is formed by winding a wire 396, which has a first flat portion 396*a*, in such a manner that the first flat portion 396*a* contacts the peripheral surface of the metal core 393. Contacting the liquid developer 32 while rotating in the clockwise direction D2, the wire bar 39*d* carries the liquid developer 32 in its carrying portions 39*a*, which are formed between the wire sections of the wire 396 as the wound wire 396 is wound around the metal core 393, and transports thus carried liquid developer 32 to the developer roller 31. Other structures are similar to those in the first through the fifth embodiments. The seventh embodiment will now be described in detail, focusing mainly on the difference from the first through the fifth embodiments. The structures and the operations which are the same as those according to the first through the fifth embodiments will not be described.

The wire bar 39*d* may be obtained by winding the wire 396 of stainless steel (SUS304) having a wire diameter of 100 μm around the peripheral surface of the metal core 393, which may be a rod-like member of steel, in such a manner that the wire 396 is tightly wound over the pitches P of 100 μm along the X-direction (which corresponds to the "longitudinal direction" of the invention). The first flat portion 396*a* is formed along the overall longitudinal length of the wire 396 in the peripheral surface of the wire 396. The wire 396 is wound around the metal core 393 such that the first flat portion 396*a* tightly contacts the peripheral surface of the metal core 393 (FIG. 13). At the both ends of the metal core 393, there are fixing/processing parts which fix the wire 396 at the start and the end of winding by spot soldering which uses laser, soldering, etc. In this manner, the wire 396 is fixed by the force of static friction created by the winding around the metal core 393 and acting upon the first flat portion 396*a* and the peripheral surface of the metal core 393 and by the fixing force created by the spot soldering or the like to the metal core 393 in the fixing/processing parts at the both ends, which permits winding of the wire 396 around the metal core 393 such that the outer diameter of the wire bar 39*d* as it is after winding of the wire 396 is 25 mm for instance.

The first flat portion 396*a* can be formed along the overall longitudinal length of the wire 396 in the peripheral surface of the wire 396 by for example the so-called "drawing" method during which a wire is drawn through a die (diamond die, etc.) having a predetermined shape of a hole. With the hole shape of the die changed, it is possible to shape the wire so that the wire has any desired cross sectional shape. Further, in this embodiment, the surface roughness Ra of the wire 396 is R1*a*≈0.03 μm and the surface roughness Ra of the metal core 393 is R3*a*≈0.15 μm.

In this embodiment, the axis-to-axis distance between the rotation axes of the wire bar 39 and those of the developer roller 31 is set shorter than the sum of the radius of the wire bar 39*d* and that of the developer roller 31, to thereby favorably move the liquid developer 32 from the wire bar 39*d* to the developer roller 31. When the diameter of the wire bar 39*d* is about 25 mm and that of the developer roller 31 is about 20 mm as described above, the axis-to-axis distance between the rotation axes of the wire bar 39 and those of the developer roller 31 may be about 22.3 mm for example.

In the developing unit 30Y having this structure, as the agitating roller 37 rotates about its central axis, the liquid developer 32 which is held in the tank 33Y is scooped up and transported to the wire bar 39*d*. The liquid developer 32 transported to the wire bar 39*d* reaches the abutting position with the regulator blade 35, as the wire bar 39*d* rotates. While the liquid developer 32 moves passed the abutting position, the regulator blade 35 scrapes off an excessive amount of the liquid developer 32, and the amount of the liquid developer 32 to be supplied to the developer roller 31 is consequently measured. In other words, owing to the carrying portions 39*a* described above, the regulator blade 35 abutting on the wire bar 39*d* scrapes the liquid developer 32 off from the wire bar 39*d* except for the liquid developer 32 carried in the carrying portions 39*a*. Further, since the size of the concaves 39*a* is determined so that a proper amount of the liquid developer 32 will be supplied to the developer roller 31, when the regulator blade 35 scrapes off the liquid developer 32 which is on the wire bar 39*d*, the liquid developer 32 measured by the concaves 39*a* to a proper amount is left in the carrying portions 39*a*.

As described above, the wire bar 39*d* is formed by winding the wire 396, which has the first flat portion 396*a* along the overall longitudinal length, around the peripheral surface of the metal core 393 in such a manner that the peripheral surface of the metal core 393 tightly contacts the first flat portion 396*a*. Within the contact portion between the metal core 393 and the wire 396 which is wound around the metal core 393, the metal core 393 contact in a large area with the wire 396, and hence, it is possible to increase the force of static friction which fixes the wound wire 396 to the metal core 393 and which acts between the wound wire 396 and the metal core 393. Since the strong force of static friction fixes the wound wire 396 to the metal core 393, it is possible to prevent the wound wire 396 from getting displaced by the force of contact friction which is created when the regulator blade 35 contacts the wound wire 396.

Further, the surface roughness R1*a* of the wire 396 and the surface roughness R3*a* of the metal core 393 satisfy the following:

Second condition: $R3a > R1a$

Since the surface roughness R3*a* of the metal core 393 in a peripheral zone of the contact portion where the wound wire 396 and the metal core 393 contact is thus large, in this contact portion, the wound wire 396 is supported also by portions surrounding the wound wire 396 because of the surface roughness of the metal core 393. Combined with the force of static friction which acts upon the wire 396 and the metal core 393, this more strongly fixes the wire 396 to the metal core 393 in this contact portion.

Further, in this embodiment, the developing unit 30 is formed so that the liquid developer 32 applied to the developer roller 31 by the wire bar 39*d* which effectively prevents loosening of the wound wire 396 prevents a coated pattern of the liquid developer 32 applied to the developer roller 31 from getting disturbed as described above. Since an electrostatic latent image on the photosensitive member is developed with the liquid developer 32 uniformly applied to the developer roller 31 of such a developing unit 30, it is possible to enhance the accuracy of development and improve the image quality of the resulting toner image.

Further, in this embodiment, since the wire bar 39*d* is pressed with the belly (surface) 35*a* of the regulator blade 35, it is possible to efficiently transmit this pressing force to a wide area within the wire bar 39*d*. Hence, it is possible to more efficiently regulate (scrape off) the excessive liquid developer 32 which is on the wire bar 39*d*. Since this achieves application of the liquid developer 32 to the developer roller 31 from the wire bar 39*d* while securely regulating the excessive liquid developer 32, it is possible to more effectively prevent a coated pattern of the liquid developer 32 applied to the developer roller 31 from getting disturbed.

Eighth Embodiment

Figure 14:
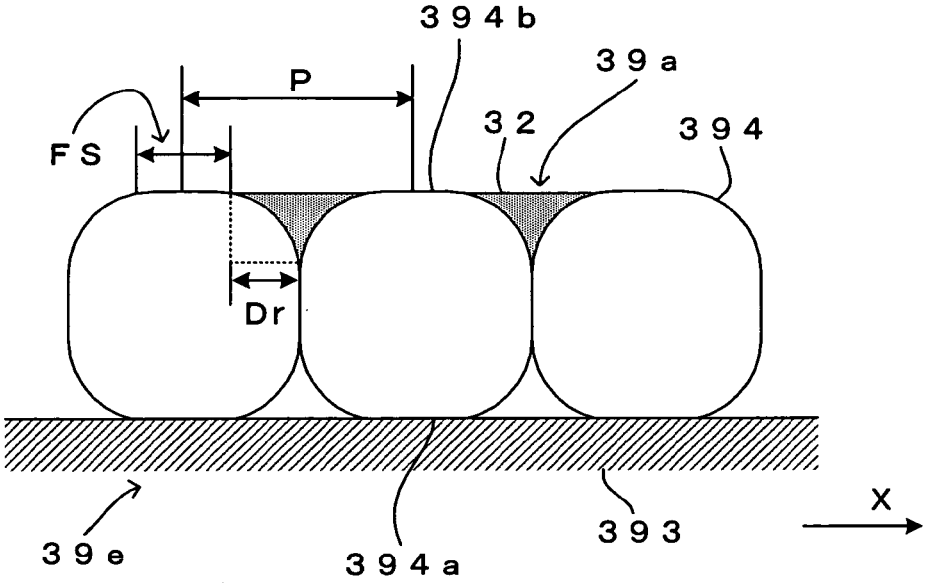
FIG. 14 is an enlarged schematic diagram of a wire bar in the eighth embodiment.

FIG. 14 is an enlarged schematic diagram of a wire bar. A major difference of the eighth embodiment from the seventh embodiment is that a wire 394 wound around the metal core 393 comprises a second flat portion 394*b*, in addition to the first flat portion 394*a* (FIG. 6). The wire 394 is processed so that its cross sectional shape is approximately rectangular. Other structures are similar to those in the seventh embodiment, and therefore, the eighth embodiment will now be described in detail, focusing mainly on the difference from the seventh embodiment. The structures and the operations which are the same as those according to the seventh embodiment will not be described.

A wire bar 39*e* and the regulator blade 35 according to the eighth embodiment are structured as described below, where P denotes the winding intervals at which the wire 394 is wound around the metal core 393 along the X-direction, Dr denotes the radius of the wire 394 in its arc portion in cross section (FIG. 14), and FS denotes the width of the second flat portion 394*b* which is formed in the wire 394 in a direction which is approximately orthogonal to the overall longitudinal direction of the wire 394.

The winding intervals (pitches P) at which the wire is tightly wound is about 127 μm.

The radius Dr of the wire is about 50 μm.

The width FS of the second flat portion is about 27 μm.

The film thickness of the liquid developer applied to the developer roller is about 8.4 μm.

The material, the hardness and the elastic constant of the regulator blade are respectively urethane rubber whose thickness is about 1.6 mm, about 77 degrees on the JIS-A scale and about 50 kg/cm$^2$ (100%).

The contact angle between the regulator blade and the wire bar is about 15 degrees.

The regulation method is trail regulation.

Described above as the film thickness of the liquid developer 32 applied to the developer roller 31 is a value as it is when all liquid developer 32 carried by the carrying portions 39*a* of the wire bar 39*e* is applied to the developer roller 31. Other structures are similar to those in the seventh embodiment. Hence, the following effects are promised, in addition to the effects according to the seventh embodiment.

In the eighth embodiment, since the second flat portion 394*b* is formed in the wire 394 along the overall longitudinal direction of the wire 394, when the wire 394 is wound such that the first flat portion 394*a* contacts the metal core 393, the second flat portion 394*b* becomes the surface of thus wound wire 394. The regulator blade 35 contacts this second flat portion 394*b*. Hence, the regulator blade 35 contacts thus wound wire 394 in a large area within the contact portion.

Hence, it is possible to make the wound wire 394 stably abut on the regulator blade 35. The regulator blade 35 can therefore securely regulate (scrape off) the liquid developer 32 which is carried by the second flat portion 394*b*. It is therefore possible to stably regulate (scrape off) the liquid developer 32 which is on the wire bar 39*e*, using the regulator blade 35.

Further, the liquid developer 32 is applied to the developer roller 31 from the wire bar 39*e*, while restricting without fail the liquid developer 32 which is on the second flat portion 394*b*. It is therefore possible to prevent transfer of the liquid developer 32 which is on the second flat portion 394*b* to the developer roller 31 from connecting on the developer roller 31 the adjacent portions of the liquid developer 32 in the carrying portions 39*a* which are adjacent on the both sides of the second flat portion 394*b*. Since it is possible to effectively prevent a coated pattern of the liquid developer 32 applied to the developer roller 31 from getting disturbed, when an electrostatic latent image on the photosensitive member is developed with the liquid developer 32, the image quality of the resulting toner image improves.

Ninth Embodiment

A major difference of the ninth embodiment from the eighth embodiment concerns the structure of the wire which is wound around the metal core. Other structures are similar to those in the eighth embodiment, and therefore, the ninth embodiment will now be described in detail, focusing mainly on the difference from the eighth embodiment. The structures and the operations which are the same as those according to the eighth embodiment will not be described.

A wire bar and the regulator blade according to the ninth embodiment are structured as described below, where P denotes the winding intervals at which the wire is wound around the metal core along the X-direction, Dr denotes the radius of the wire in its arc portion in cross section (FIG. 14), and FS denotes the width of the second flat portion which is formed in the wire in a direction which is approximately orthogonal to the overall longitudinal direction of the wire.

The winding intervals (pitches P) at which the wire is tightly wound is about 150 μm.

The radius Dr of the wire is about 60 μm.

The width FS of the second flat portion is about 30 μm.

The film thickness of the liquid developer applied to the developer roller is about 10.3 μm.

The material, the hardness and the elastic constant of the regulator blade are respectively phosphor bronze whose thickness is about 0.5 mm, about 200 HV and about 9800 kg/mm$^2$ (100%).

The contact angle between the regulator blade and the wire bar is about 10 degrees.

The regulation method is trail regulation.

Described above as the film thickness of the liquid developer applied to the developer roller is a value as it is when all liquid developer 32 carried by the carrying portions of the wire bar is applied to the developer roller. Other structures are similar to those in the eighth embodiment. Hence, similar effects to the effects according to the eighth embodiment are achieved.

Tenth Embodiment

Figure 15:
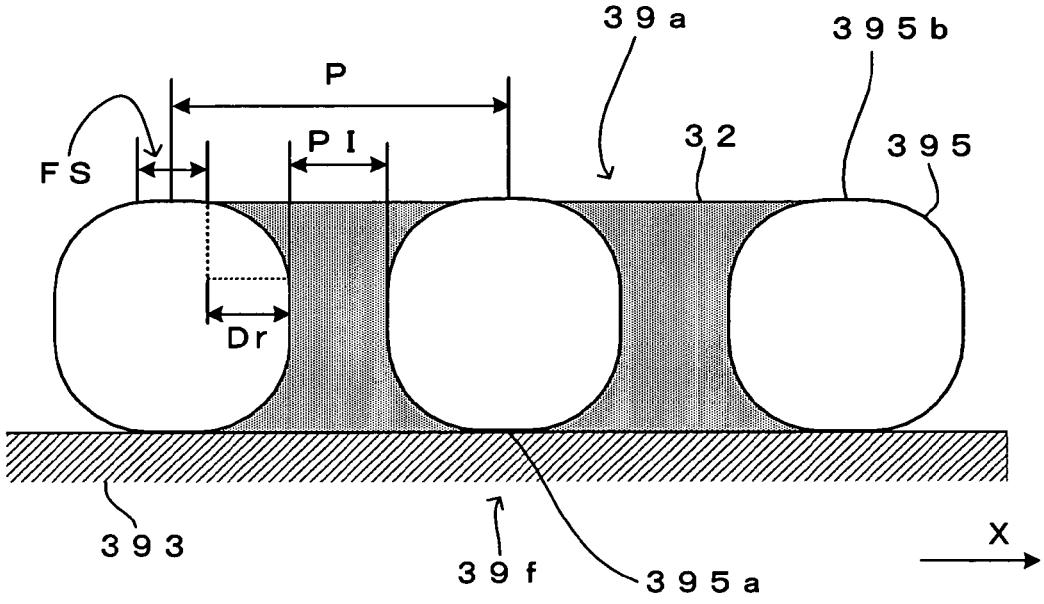
FIG. 15 is an enlarged schematic diagram of a wire bar in the tenth embodiment.

FIG. 15 is an enlarged schematic diagram of a wire bar. A major difference of the tenth embodiment from the eighth and the ninth embodiments concerns the structure and the winding of a wire 395 which is wound around the metal core 393. In the tenth embodiment, the wire 395 is wound around the metal core 393 so that predetermined wire gaps are provided between wire sections along the X-direction (FIG. 15). Other structures are similar to those in the eighth and the ninth embodiments, and therefore, the tenth embodiment will now be described in detail, focusing mainly on the difference from the eighth and the ninth embodiments. The structures and the operations which are the same as those according to the eighth and the ninth embodiments will not be described.

A wire bar 39*f* and the regulator blade 35 according to the tenth embodiment are structured as described below, where P denotes the winding intervals at which the wire 395 is wound around the metal core 393 along the X-direction, Dr denotes the radius of the wire 395 in its arc portion in cross section (FIG. 15), FS denotes the width of the second flat portion 395*b* which is formed in the wire 395 in a direction which is approximately orthogonal to the overall longitudinal direction of the wire 395, PI (which corresponds to the "predetermined gap" of the invention) denotes the wire gaps in the X-direction.

The winding intervals (pitches P) at which the wire is wound is about 100 μm.

The radius Dr of the wire is about 30 μm.

The width FS of the second flat portion is about 30 μm.

The wire gaps PI are about 10 μm.

The film thickness of the liquid developer applied to the developer roller is about 10.3 μm.

The material, the hardness and the elastic constant of the regulator blade are respectively stainless steel whose thickness is about 0.15 mm (SUS304), about 170 HV and about 21000 kg/mm$^2$ (100%).

The contact angle between the regulator blade and the wire bar is about 5 degrees.

The regulation method is trail regulation.

Described above as the film thickness of the liquid developer applied to the developer roller is a value as it is when all liquid developer 32 carried by the carrying portions 39*a* of the wire bar 39*f* is applied to the developer roller 31. Other structures are similar to those in the eighth and the ninth embodiments. Hence, the following effects are promised, in addition to the effects according to the eighth and the ninth embodiments.

Where the conventional techniques are deployed, use of the structure above wherein the wire 395 is wound around the metal core 393 with the predetermined wire gaps PI may result in insufficient force of fixing the wire 395 to the metal core 393 and deviation of the wound wire 395 when the wire bar 39*f* is used. However, since the wire 395 is wound around the metal core 393 in a manner such that the first flat portion 395*a* contacts the peripheral surface of the metal core 393 in this embodiment, the force of static friction which acts in the contact portion between the wire 395 and the metal core 393 increases and the wound wire 395 is fixed stably to the metal core 393. Since this permits winding the wire 395 around the metal core 393 with the predetermined wire gaps PI, it is possible to enlarge the range in which the size of the carrying portions 39*a* of the wire bar 39*f* can be changed. As a result, it is possible to expand the range in which the amount of the liquid developer 32 carried by the wire bar 39*f* can be adjusted, and hence, it is possible to expand the range in which the film thickness of the liquid developer 32 applied to the developer roller 31 can be adjusted.

Eleventh Embodiment

Figure 16:
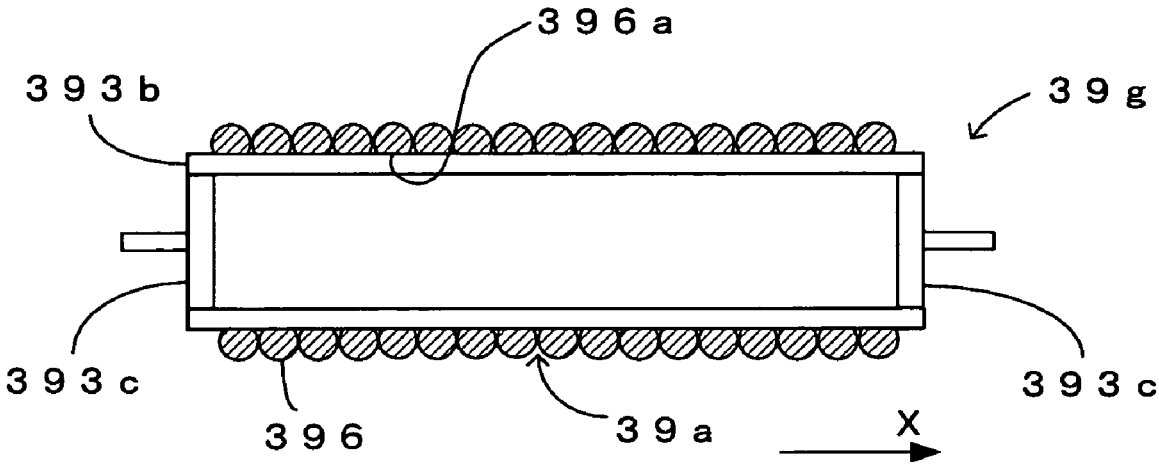
FIG. 16 is an enlarged schematic diagram of a wire bar in the eleventh embodiment.

FIG. 16 is an enlarged schematic diagram of a wire bar. A major difference of the eleventh embodiment from the seventh embodiment is that the rod-like member of a wire bar 39*g* is formed as the hollow metal core 393*b*. Other structures are similar to those in the seventh embodiment. The eleventh embodiment will now be described in detail, focusing mainly on the difference from the seventh embodiment. The structures and the operations which are the same as those according to the seventh embodiment will not be described.

In the eleventh embodiment, the rod-like member according to the invention is formed as the hollow metal core 393*b*. Further, at the both ends, there are flanges 393*c* having rotation axes. Since the rod-like member is hollow, the weight of the apparatus is reduced. The outer diameter of the hollow metal core 393*b* may be about 25 mm and the inner diameter of the hollow metal core 393*b* may be about 20 mm, for instance. Other structures are similar to those in the seventh embodiment. Hence, the following effects are promised, in addition to the effects according to the seventh embodiment.

When the rod-like member is formed as the hollow metal core 393*b* as in this embodiment, although the weight of the apparatus is reduced, the strength of the hollow metal core 393*b* is inferior to that of the metal core 393. Therefore, use of a similar structure to those according to the embodiments above causes a problem that the hollow metal core 393*b* is more likely to be distorted than the metal core 393. However, as described above, since the wire 396 is wound such that the first flat portion 396*a* contacts the peripheral surface of the hollow metal core 393*b*, the force of static friction which acts in the contact portion between the wire 396 and the hollow metal core 393*b* increases and the wound wire 396 is strongly fixed to the metal core 393. Hence, it is possible to prevent distortion of the hollow metal core 393*b* from deviating the wound wire 396. The hollow metal core 393*b* according to this embodiment may of course be used in the eighth through the tenth embodiments.

Twelfth Embodiment

Figure 17:
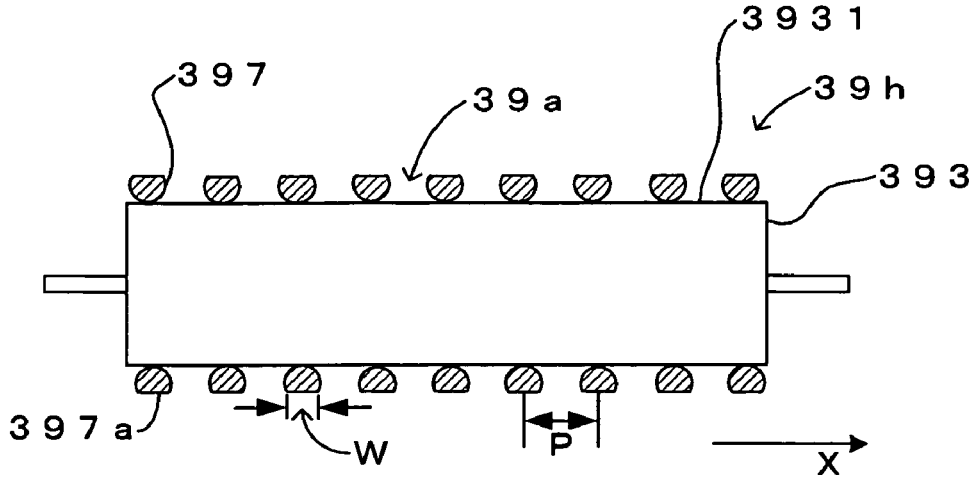
FIG. 17 is an enlarged schematic diagram of a wire bar in the twelfth embodiment.
Figure 18:
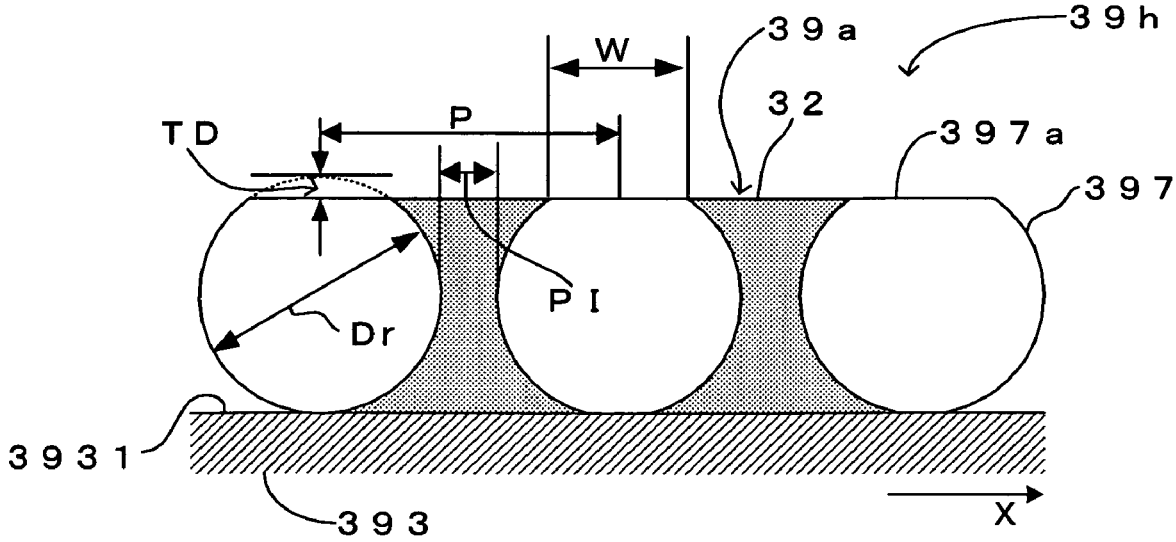
FIG. 18 is an enlarged schematic diagrams of a wire bar.

FIGS. 17 and 18 are enlarged schematic diagrams of a wire bar according to the invention. A major difference of the twelfth embodiment from the first through the fifth embodiments above is that a regulator surface portion 397*a* whose width is W is formed along the X-direction in the surface of a wound wire 397 which is formed by winding a wire 397 around the metal core 393 in such a manner that the regulator surface portion 397*a* is approximately parallel to a peripheral surface 3931 of the metal core 393. Contacting the liquid developer 32 while rotating in the clockwise direction D2, a wire bar 39*h* carries the liquid developer 32 in its carrying portions 39*a*, which are formed between the wire sections of the wound wire 397 as the wire 397 is wound around the metal core 393, and transports thus carried liquid developer 32 to the developer roller 31. Other structures are similar to those in the first through the fifth embodiments. The twelfth embodiment will now be described in detail, focusing mainly on the difference from the first through the fifth embodiments. The structures and the operations which are the same as those according to the first through the fifth embodiments will not be described.

The wire bar 39*h* may be obtained by winding the wire 397 of stainless steel (SUS304) having a wire diameter (Dr) of about 50 μm around the metal core 393, which may be a rod-like member of steel, along the X-direction (which corresponds to the "longitudinal direction" of the invention) around the peripheral surface of the metal core 393 over the pitches P of about 75 μm in such a manner that the wire 397 is apart from each other by the wire gaps PI of about 25 μm (FIG. 18). In the surface of the wound wire 397 which is formed by winding the wire 397 around the metal core 393, there is the regulator surface portion 397*a* which is approximately parallel to the peripheral surface 3931 of the metal core 393 and has the width W along the X-direction. In this embodiment, as described later in detail with reference to FIGS. 19A through 19D, after winding an unprocessed wire 3971 whose cross section is shaped approximately circular around the metal core 393 at winding step, at a regulator surface portion forming step, the surface of the unprocessed wire 3971 is polished (by abrasive machining) to the polishing depth TD of about 5 μm, thereby forming the regulator surface portion 397*a*.

At the both ends of the metal core 393, fixing/processing parts are attached which are for fixing the wire 397 at the start and the end of winding for example by spot soldering which uses laser, soldering, etc. In this manner, the wire 397 is fixed by the force of static friction created by the winding around the metal core 393 and acting upon the wound wire 397 and the peripheral surface of the metal core 393 and by the fixing force created by the spot soldering or the like to the metal core 393 in the fixing/processing parts at the both ends, which permits winding of the wire 397 around the metal core 393 such that the outer diameter of the wire bar 39*h* as it is after winding of the wire 397 is 25 mm for instance.

In this embodiment, the axis-to-axis distance between the rotation axes of the wire bar 39*h* and those of the developer roller 31 is set shorter than the sum of the radius of the wire bar 39*h* and that of the developer roller 31, to thereby favorably move the liquid developer 32 from the wire bar 39*h* to the developer roller 31. When the diameter of the wire bar 39*h* is about 25 mm and that of the developer roller 31 is about 20 mm as described above, the axis-to-axis distance between the rotation axes of the wire bar 39*h* and those of the developer roller 31 may be about 22.3 mm for example.

In the developing unit 30Y having this structure, as the agitating roller 37 rotates about its central axis, the liquid developer 32 which is held in the tank 33Y is scooped up and transported to the wire bar 39*h*. The liquid developer 32 transported to the wire bar 39*h* reaches the abutting position with the regulator blade 35, as the wire bar 39*h* rotates. While the liquid developer 32 moves passed the abutting position, the regulator blade 35 scrapes off an excessive amount of the liquid developer 32, and the amount of the liquid developer 32 to be supplied to the developer roller 31 is consequently measured. In other words, owing to the carrying portions 39*a* described above, the regulator blade 35 abutting on the wire bar 39*h* scrapes the liquid developer 32 off from the wire bar 39*h* except for the liquid developer 32 carried in the carrying portions 39*a*. Further, since the size of the carrying portions 39*a* is determined so that a proper amount of the liquid developer 32 will be supplied to the developer roller 31, when the regulator blade 35 scrapes off the liquid developer 32 which is on the wire bar 39*d*, the liquid developer 32 measured by the carrying portions 39*a* to a proper amount is left in the carrying portions 39*a*.

The wire bar 39*h* scoops up the liquid developer 32 which is held in the tank 33Y, the regulator blade 35 restricts the amount of the liquid developer 32 on the wire bar 39*h* to the constant amount, and the constant liquid developer 32 is applied to the surface of the developer roller 31 at the coating position 17. The film thickness of the liquid developer 32 applied to the developer roller 31 is about 11.9 μm when all liquid developer 32 carried by the carrying portions 39*a* of the wire bar 39*h* is applied to the developer roller 31.

A method of manufacturing the wire bar 39*h* will now be described in detail with reference to FIGS. 19A through 19D.

FIGS. 19A to 19D are drawings which show the respective steps through which the wire bar is manufactured. FIG. 19A shows the metal core 393 and the unprocessed wire 3971 which form the wire bar 39*h*. Although the cross section of the unprocessed wire 3971 is shaped approximately circular as shown in FIG. 19A, an unprocessed wire whose cross section is shaped approximately oval may be used instead. Further, in this embodiment, the surface roughness Ra of the unprocessed wire 3971 is R4*a*≈0.03 μm and the surface roughness Ra of the metal core 393 is R3*a*≈0.15 μm.

First, at the winding step, the unprocessed wire 3971 is wound around the metal core 393 at a predetermined designed position (FIG. 19B). In this manner, the unprocessed wire 3971 wound around the metal core 393 is fixed by the force of static friction created by the winding around the metal core 393 and acting upon the wound unprocessed wire 3971 and the peripheral surface of the metal core 393 and by the fixing force created by the spot soldering or the like to the metal core 393 in the fixing/processing parts at the both ends. The winding step is followed by the regulator surface portion forming step of forming the regulator surface portion 397*a* in the surface of the unprocessed wire 3971 thus wound around the metal core 393 (FIG. 19C). At the regulator surface portion forming step shown in FIG. 19C, by so-called wrapping which is categorized as an abrasive machining method, the regulator surface portion 397*a* is formed in the surface of the unprocessed wire 3971. To be specific, the rotation axis at one end of the metal core 393 is fixed to a chuck 80 of a lathe whose main section is not shown, and the metal core 393 is rotated together with the wound unprocessed wire 3971 in the direction of the arrow shown in FIG. 19C. A resin 81 bearing a liquid polisher 82 is brought into contact with the wound unprocessed wire 3971 whiz is rotating in this fashion, thereby polishing the wire 3971 to a predetermined depth. The polishing of the wire 3971 to the predetermined depth is the end of the regulator surface portion forming step and completes the wire bar 39*h* (FIG. 19D). The liquid polisher 82 is obtained by dispersing alumina in an aqueous liquid, for instance. The length of the resin 81 along the X-direction is longer than the length of the wound unprocessed wire 3971 along the X-direction. The resin may be replaced with a wooden block, etc.

As described above, in this embodiment, the wire bar 39*h* is formed by winding the wire 397 around the metal core 393. The wound wire 397 wound around the metal core 393 comprises in its surface the regulator surface portion 397*a* whose width is W along the X-direction and which is approximately parallel to the peripheral surface 3931 of the metal core 393. As the regulator blade 35 contacts the regulator surface portion 397*a*, the regulator blade 35 scrapes off the excessive liquid developer 32 which is on the wire bar 39*h*, namely, the liquid developer 32 which is on the regulator surface portion 397*a*. Since the regulator blade 35 contacts the wound wire 397 which comprises the regulator surface portion 397*a* which has the width W along the X-direction, the regulator blade 35 contacts thus wound wire 397 in a large area within the contact portion. Hence, it is possible to make the wound wire 397 stably abut on the regulator blade 35. The regulator blade 35 can therefore securely regulate (scrape off) the liquid developer 32 which is on the wire bar 39*h*.

Further, in the developing unit 30 of this embodiment, with the liquid developer 32 on the regulator surface portion 397*a* regulated without fail, the liquid developer 32 is applied to the developer roller 31 by the wire bar 39*h*. Hence, it is possible to prevent transfer of the liquid developer 32 which is on the regulator surface portion 397*a* to the developer roller 31 from connecting on the developer roller 31 the adjacent portions of the liquid developer 32 in the carrying portions 39*a* which are adjacent on the both sides of the regulator surface portion 397*a*. It is thus possible to effectively prevent a coated pattern of the liquid developer 32 applied to the developer roller 31 from getting disturbed, Since an electrostatic latent image on the photosensitive member is developed with the liquid developer 32 uniformly applied to the developer roller 31 without any disturbance, it is possible to enhance the accuracy of development and improve the image quality of the resulting toner image.

Further, the surface roughness R4*a* of the unprocessed wire 3971 and the surface roughness R3*a* of the metal core 393 satisfy the following:

$$R3a>R4a$$

Since the surface roughness of the metal core 393 in a peripheral zone of the contact portion where the wound unprocessed wire 3971 and the metal core 393 contact is thus large, in this contact portion, the wound unprocessed wire 3971 is supported also by portions surrounding the wound unprocessed wire 3971 because of the surface roughness of the metal core 393. Combined with the force of static friction which acts upon the wound unprocessed wire 3971 and the metal core 393, this more strongly fixes the wound unprocessed wire 3971 to the metal core 393 in this contact portion. At the regulator surface portion forming step shown in FIG. 19C, it is possible to effectively prevent the wound unprocessed wire 3971 wound around the metal core 393 from getting deviated from its designed position while the regulator surface portion 397*a* is formed in the wound unprocessed wire 3971. In addition, during actual use, the wire bar 39*h* manufactured in the manner above is strongly fixed to the metal core 393 for a similar reason. Hence, it is possible to prevent the wound wire 397 from getting deviated from its designed position during actual use.

Further, in this embodiment, since the wire bar 39*h* is pressed with the belly (surface) 35*a* of the regulator blade 35, it is possible to efficiently transmit this pressing force to a wide area within the wire bar 39*h*. Hence, it is possible to more efficiently regulate (scrape off) the excessive liquid developer 32 which is on the wire bar 39*h*. Since this achieves application of the liquid developer 32 to the developer roller 31 from the wire bar 39*h* while securely regulating the excessive liquid developer 32, it is possible to more effectively prevent a coated pattern of the liquid developer 32 applied to the developer roller 31 from getting disturbed.

Thirteenth Embodiment

Figure 20:
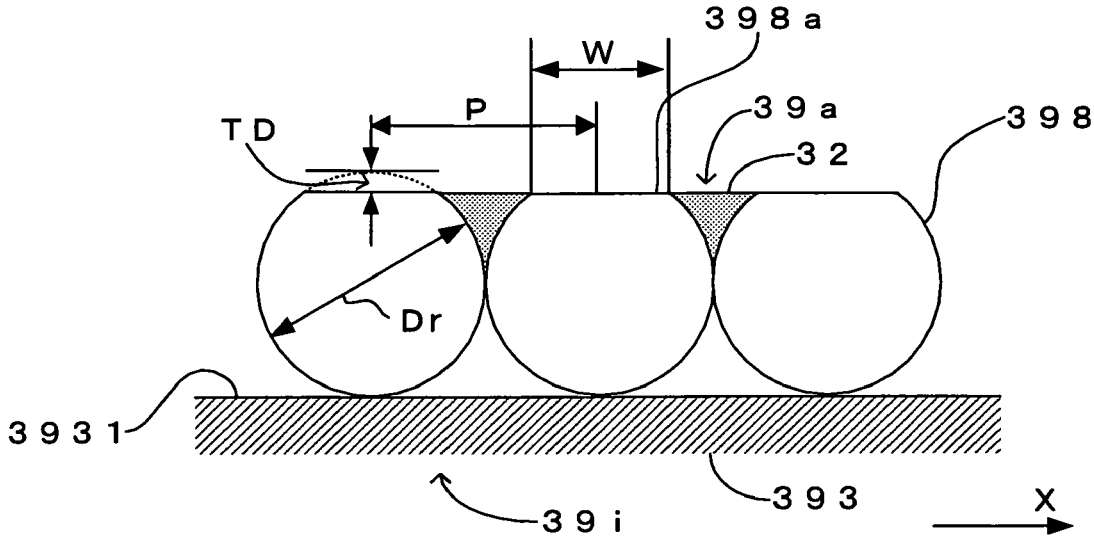
FIG. 20 is an enlarged schematic diagram of a wire bar in the thirteenth embodiment.

FIG. 20 is an enlarged schematic diagram of a wire bar. A major difference of the thirteenth embodiment from the twelfth embodiment concerns the structure and the winding of a wire 398 which is wound around the metal core 393. At the winding step in the thirteenth embodiment, the wire 398 is wound around the metal core 393 so that the wire comes in tight contact along the X-direction (FIG. 20). Other structures are similar to those in the twelfth embodiment, and therefore, the thirteenth embodiment will now be described in detail, focusing mainly on the difference from the twelfth embodiment. The structures and the operations which are the same as those according to the twelfth embodiment will not be described.

A wire bar 39*i* and the regulator blade 35 according to the thirteenth embodiment are structured as described below, where P denotes the winding intervals at which the wire 398 is wound around the metal core 393 along the X-direction, Dr denotes the wire radius of the wire 398, and TD denotes the polishing depth to which the surface of the wound unprocessed wire is polished.

The winding intervals (pitches P) at which the wire is tightly wound is about 170 μm.

The wire radius Dr of the wire is about 170 μm.

The polishing depth TD is about 5.5 μm.

The film thickness of the liquid developer applied to the developer roller is about 14.1 μm.

The material, the hardness and the elastic constant of the regulator blade are respectively phosphor bronze whose thickness is about 0.5 mm, about 200 HV and about 9800 kg/mm$^2$.

The contact angle between the regulator blade and the wire bar is about 10 degrees.

The regulation method is trail regulation.

Described above as the film thickness of the liquid developer 32 applied to the developer roller 31 is a value as it is when all liquid developer 32 carried by the carrying portions 39*a* of the wire bar 39*i* is applied to the developer roller 31. Other structures are similar to those in the twelfth embodiment. Hence, the following effects are promised, in addition to the effects according to the twelfth embodiment.

In the thirteenth embodiment, since the unprocessed wire is wound in so-called "tight winding" around the metal core 393, the wound unprocessed wire is more strongly fixed to the metal core 393. Hence, while the regulator surface portion is formed in the wound unprocessed wire (the regulator surface portion forming step), it is possible to effectively prevent the unprocessed wire wound around the metal core 393 from getting deviated from its designed position.

Fourteenth Embodiment

A major difference of the fourteenth embodiment from the thirteenth embodiment concerns the structure of the wire wound around the metal core. Other structures are similar to those in the thirteenth embodiment, and therefore, the fourteenth embodiment will now be described in detail, focusing mainly on the difference from the thirteenth embodiment. The structures and the operations which are the same as those according to the thirteenth embodiment will not be described.

The wire bar and the regulator blade according to the fourteenth embodiment are structured as described below, where P denotes the winding intervals at which the wire is wound around the metal core along the X-direction, Dr denotes the wire radius of the wire, and TD denotes the polishing depth to which the surface of the wound unprocessed wire is polished.

The winding intervals (pitches P) at which the wire is tightly wound is about 130 μm.

The wire radius Dr of the wire is about 130 μm.

The polishing depth TD is about 5.0 μm.

The film thickness of the liquid developer applied to the developer roller is about 10.2 μm.

The material, the hardness and the elastic constant of the regulator blade are respectively stainless steel (SUS304) whose thickness is about 0.2 mm, about 170 HV and about 21000 kg/mm$^2$.

The contact angle between the regulator blade and the wire bar is about 5 degrees.

The regulation method is trail regulation.

Described above as the film thickness of the liquid developer applied to the developer roller is a value as it is when all liquid developer carried in the concaves (carrying portions) of the wire bar is applied to the developer roller. Other structures are similar to those in the thirteenth embodiment. Hence, similar effects to the effects according to the thirteenth embodiment are obtained.

Fifteenth Embodiment

Figure 21:
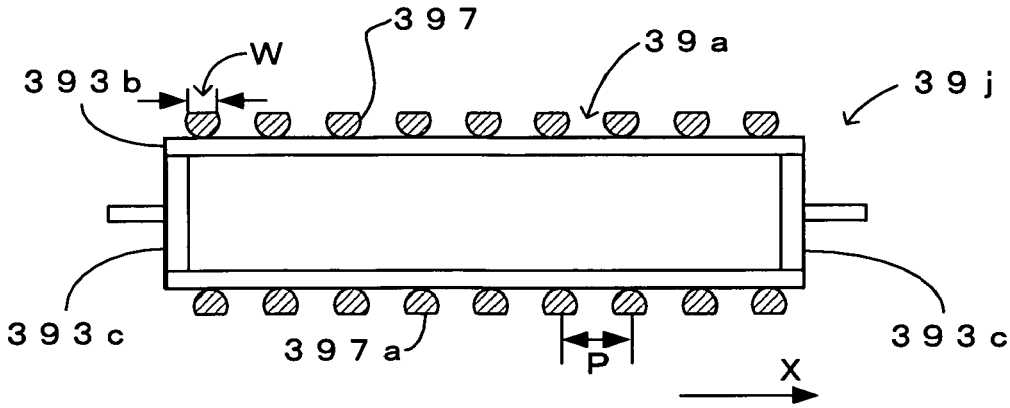
FIG. 21 is an enlarged schematic diagram of a wire bar in the fifteenth embodiment.

FIG. 21 is an enlarged schematic diagram of a wire bar. A major difference of the fifteenth embodiment from the twelfth embodiment is that the rod-like member of a wire bar 39*j* is formed as the hollow metal core 393*b*. Other structures are similar to those in the twelfth embodiment. The fifteenth embodiment will now be described in detail, focusing mainly on the difference from the twelfth embodiment. The structures and the operations which are the same as those according to the twelfth embodiment will not be described.

In the fifteenth embodiment, the rod-like member according to the invention is formed as the hollow metal core 393*b*. Further, at the both ends, there are flanges 393*c* having rotation axes. Since the rod-like member is hollow, the weight of the apparatus is reduced. The outer diameter of the hollow metal core 393*b* may be about 25 mm and the inner diameter of the hollow metal core 393*b* may be about 20 mm, for instance. Other structures are similar to those in the twelfth embodiment. Hence, similar effects to the effects according to the twelfth embodiment are promised. The metal core 393*b* according to this embodiment may of course be used in the thirteenth and the fourteenth embodiments.

Others

The invention is not limited to the embodiment above, but may be modified in various manners in addition to the embodiments above, to the extent not deviating from the object of the invention. For instance, in the first through the sixth embodiments described above, the wire diameter of the wire 391, how the wire 391 is wound and the widths W1, W2 and W3 are not limited to the numerical values described above but may be set in accordance with the desired film thickness of the liquid developer 32, the size of an image, etc.

Further, the wire diameter of the wire is preferably 10μm or larger in light of technical issues related to manufacturing. When an elastic regulator blade is used as the regulator member, as the blade is compressed and deformed, the blade may get into the carrying portions which are between the wire sections by about a few μm and the amount of the liquid developer 32 on the wire bar may therefore be restricted more than the intention. Noting this, the wire diameter of the wire is preferably 15 μm or larger.

Further, although the first through the fourth and the sixth embodiments above require so-called trail regulation, this may be replaced with counter regulation. On the contrary, although the fifth embodiment requires so-called counter regulation, this may be replaced with trail regulation. In essence, any structure in which the wire 391 is pressed with the belly (surface) of the regulator blade attains similar effects to those according to the embodiments above.

Further, although the developing agent carrier is formed by the developer roller 31 in the embodiments above, the developing agent carrier may be formed by a developer belt which develops an electrostatic latent image on the latent image carrier and the coating roller which is coated at its surface with the liquid developer by the wire bar and applies this liquid developer to the developer belt. Alternatively, the developing agent carrier may of course be formed only by a developer belt.

Further, although the embodiments above require that the approximately central sections of the widths W1 through W3 are on the straight line CL, one ends of these widths may be aligned to each other on one straight line.

Further, although one exposure unit 20 is disposed for each one of the photosensitive members 11Y, 11M, 11C and 11K so that an electrostatic latent image corresponding to each one of the photosensitive members 11Y, 11M, 11C and 11K is formed on each one of the photosensitive members 11Y, 11M, 11C and 11K in the embodiments above, an alternative structure may be used instead in which one exposure unit is disposed, and an electrostatic latent image corresponding to each one of the photosensitive members 11Y, 11M, 11C and 11K is formed on each one of the photosensitive members 11Y, 11M, 11C and 11K by switching, with a mirror or the like, the direction in which a laser beam is irradiated for instance. In addition, an exposure unit formed by an LED array may be used, or a latent image writer for so-called charging for writing may be used. Any structure may be used to the extent electrostatic latent images each corresponding to each one of the photosensitive members 11Y, 11M, 11C and 11K can be formed on each one of the photosensitive members 11Y, 11M, 11C and 11K.

Further, although the foregoing has described the fifth and the sixth embodiments in relation to use of the regulator blade 35, this regulator blade 35 may of course be replaced with the regulator blade 35*b* or 35*c* according to the second or the third embodiment.

The regulator blade 35*c* according to the third embodiment may of course be used in the second embodiment. In this case, similar concaves to those of the regulator blade 35*b* may be formed in the central portion of the regulator blade 35*c*.

Although the second embodiment uses the regulator blade 35*b* which is elastic, in the event that such concaves are formed in any regulator blade, even if the regulator blade is not elastic, similar effects are nevertheless obtained.

Further, although all embodiments above use the regulator member which is shaped like a blade, the shape of the regulator member is not limited to this. For instance, even when the regulator member which is shaped as an elastic roller is used, similar effects are attained.

Further, the position at which the regulator member contacts the wire bar is not limited to the position at which the regulator member contacts the wire bar in the embodiments above. This position may be any position as long as it is located between the coating position 17 and the contact position at which the wire bar contacts the liquid developer 32 which is held in the tank 33Y, which is along the direction of rotations D2 of the wire bar.

Further, although the embodiments above are directed to application of the invention to a color printer of the tandem type, the structure according to the invention is applicable to a monochrome printer.

Further, although the foregoing has described the embodiments as a printer which prints onto a transfer paper an image fed from an external apparatus such as a host computer, the invention is not limited to this but may be applied to an ordinary image creating apparatus of the electrophotographic type including a copier machine and a facsimile machine. The invention is generally applicable to any image creating apparatus in which a wire bar temporarily carries a liquid developing agent in which toner is dispersed in a carrier liquid, thus carried liquid developing agent is applied to a developing agent carrier and the liquid developing agent applied to the developing agent carrier develops an electrostatic latent image which is on the latent image carrier.

Further, the numerical values regarding the cross sectional shape of the wire, the numerical values regarding the winding intervals for winding the wire around the rod-like member and the numerical values regarding the regulator member are not limited to the numerical values above but may be set in accordance with manufacturing conditions, the materials, film thickness of the liquid developer applied to the developer roller, etc.

Further, in the eighth through the tenth embodiments described above, the surface roughness values Ra of the first and the second flat portions are approximately the same. However, where the surface roughness of the first flat portion 394*a* is R1*b* and that of the first flat portion 395*a* is R1*c*, the surface roughness of the second flat portion 394*b* is R2*b* and that of the second flat portion 395*b* is R2*c*, the following condition may be satisfied instead.

First condition: $R1(R1b, R1c) > R2(R2b, R2c)$

In this structure, since the surface roughness values R1*b* and R1*c* of the first flat portions 394*a* and 395*a* which contact the metal core 393 are large, the force of static friction which acts in the contact portions between the metal core 393 and the wires 394 and 395 increases and the wound wires 394 and 395 are more strongly fixed to the metal core 393. In addition, since the surface roughness values R2*b* and R2*c* of the second flat portions 394*b* and 395*b* which abut on the regulator blade 35 are small, the wound wires obtained by winding the wires 394 and 395 about the metal core 393 smoothly abut on the regulator blade 35. The regulator blade 35 can therefore more stably regulate the liquid developer 32 which is on the wire bars 39*e* and 39*f*. Still further, where the second condition above is satisfied at the same time that the first condition is met, it is possible to more strongly fix the wires 394 and 395 to the metal core 393.

Figure 22A:
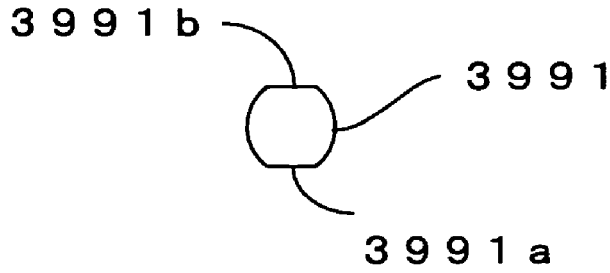
FIGS. 22A and 22B are examples of wires.
Figure 22B:
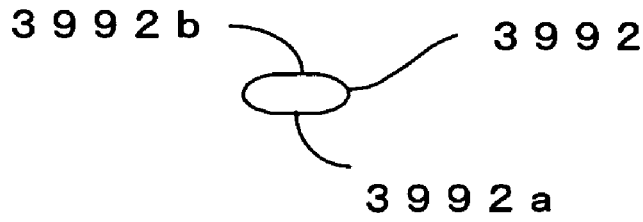
Figure 24:
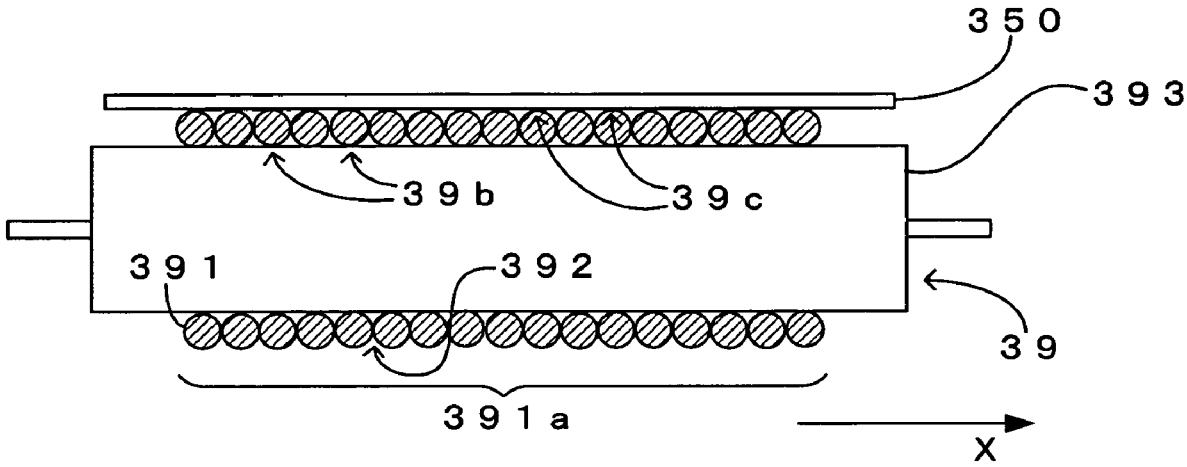
FIG. 24 is a drawing which shows the regulator member as it is disposed in contact with the wire bar in the conventional apparatus.

Further, although the wires 394 and 395 whose cross sectional shapes are approximately rectangular are wound around the metal core 393 and the wire bars 39*e* and 39*f* are obtained in the eighth through the tenth embodiments described above, the cross sectional shapes are not limited to this shape. Wires 3991 and 3992 having cross sectional shapes as those shown in FIGS. 22A and 22B may be used for instance. FIGS. 22A and 22B show examples of wires. FIG. 22A shows the wire 3991 whose cross sectional shape is approximately like a barrel and includes a first flat portion 3991*a* and a second flat portion 3991*b*. FIG. 22B shows the wire 3991 whose cross sectional shape is approximately oval and includes a first flat portion 3992*a* and a second flat portion 3992*b*. Use of the wires 3991 and 3992 realizes similar effects to those according to the eighth through the tenth embodiments described above.

Further, in the seventh through the fifteenth embodiments described above, the regulator blade 35 may of course be disposed such that its front tip is directed toward the downstream side along the direction of rotations of the wire bar for so-called trail regulation, or alternatively, toward the upstream side along the direction of rotations of the wire bar for so-called counter regulation. In addition, the regulator member may be formed by a regulator roller. Even a regulator member not comprising the "steps" of the invention achieves similar effects to those according to the seventh through the fifteenth embodiments described above. In short, the invention is applicable to a regulator member which contacts the wire bar and regulates the amount of the liquid developer which is on the wire bar.

Further, although the wire bar according to the invention carries a liquid developing agent as the liquid in the seventh through the fifteenth embodiments described above, the carried liquid is not limited to a liquid developing agent. In essence, any structure may be used in which various types of liquids are carried depending upon the intended purpose.

Further, although the twelfth through the fifteenth embodiments described above use an abrasive machining method to form the regulator surface portion in the wire at the regulator surface portion forming step, the method is not limited to an abrasive machining method as long as it is a processing method which permits forming the regulator surface portion in the wire. Other usable processing method is a cutting method as that shown in FIGS. 23A through 23D for instance. FIGS. 23A through 23D show the respective steps through which the wire bar is manufactured. As shown in FIG. 23C, as a cutting tool 83 is moved along the direction denoted at the arrow in FIG. 23C, the surface of the wound unprocessed wire 3971 is cut by any desired depth.

Further, although the twelfth through the fifteenth embodiments described above require forming the regulator surface portion in the surface of the wound unprocessed wire after winding the wire whose cross sectional shape is approximately circular around the metal core 393 to manufacture the wire bar, the method of manufacturing the wire bar is not limited to this method. For example, a wire whose peripheral surface comprises a flat portion along the overall longitudinal length of the wire may of course be wound around the metal core 393, to make this flat portion serve as the surface of the wire bar, namely the regulator surface portion, and to manufacture the wire bar. In this case, it is possible to form the flat portion along the overall longitudinal length on the peripheral surface of the wire by the so-called "drawing" method during which a wire is drawn through a die (diamond die, etc.) having a predetermined shape of a hole for instance. With the hole shape of the die changed, it is possible to shape the wire so that the wire has any desired cross sectional shape.

As in the seventh through the fifteenth embodiments described above, the method of winding the wire around the rod-like member may be "tight winding" in which the wire is tightly wound or "pitch winding" in which the wire is wound so that the wire sections are spaced apart by predetermined gaps. The angle at which the wire is wound around the rod-like member (the angle of the wire with respect to the direction which is approximately orthogonal to the longitudinal direction of the rod-like member) may be variously changed. As for the number of the wires to wind around the rod-like member, one wire may be wound or plural wires may be wound. In short, depending upon the structure of the apparatus and the intended purpose, the method of winding the wire around the rod-like member may be variously changed.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a latent image carrier which carries an electrostatic latent image;

a developing agent housing part which holds a liquid developing agent;

a developing roller which contacts the latent image carrier to supply the liquid developing agent to the latent image carrier to develop the electrostatic latent image;

a wire bar which comprises a rod-like member which has a shape of a cylinder and a wire which is wound around the rod-like member, contacts the liquid developing agent held inside the developing agent housing part while the wire bar rotates to carry the liquid developing agent thereon, and contacts the developing roller to apply the liquid developing agent to the developing roller, each end of the wire being fixed to the rod-like member; and a regulator member whose central portion is flat and which contacts a surface of the wire at the flat central portion under pressure to restrict an amount of the liquid developing agent carried on the wire, wherein the wire bar is so arranged that an axis-to-axis distance between a rotation axis of the wire bar and that of the developing roller is shorter than a sum of a radius of the wire bar and that of the developing roller, a width in a rotation axis direction of the regulator member is longer than a width in the rotation axis direction of a wound area of the wire, each end of the regulator member which is located on the outer side to the wire and a curved surface of the rod-like member are spaced apart from each other, and a distance between each end of the regulator member and the curved surface of the rod-like member is shorter than a distance between the central portion of the regulator member and the curved surface of the rod-like member, and a step is formed at the boundary between the central portion of the regulator member and each end of the regulator member, the steps fitting with the ends of the wire in the rotation axis direction, so that the regulator member presses the wire as if to wrap the wire.

2. The image forming apparatus of claim 1, wherein the regulator member is formed by an elastic member, and when the regulator member contacts the wire, the central portion is compressed and deformed and the step is formed.

3. The image forming apparatus of claim 1, wherein the regulator member has in its central portion a concave which corresponds to the wound area of the wire, and the inner bottom surface of the concave contacts a the surface of the wire.

4. The image forming apparatus of claims 1, wherein along the longitudinal length of the wire bar which is approximately orthogonal to the direction of rotations, the width of the regulator member is longer than the width of the wire bar, and the both ends of the regulator member are located on the outer side to the both ends of the wire bar.

5. The image forming apparatus of claims 1, wherein the rod-like member is hollow inside.

6. The image forming apparatus of claims 1, wherein the regulator member contacts the wire bar at a position which is about 180 degrees from the coating position about the center of rotations of the wire bar.

7. The image forming apparatus of claims 1, wherein the regulator member is a regulator blade, and a belly portion of the regulator blade contacts the wire bar.

8. The image forming apparatus of claim 7, further comprising (c) a support member which supports the regulator blade, wherein assuming that a contact angle is the angle between the tangent line to an outer peripheral surface of the wire bar and the regulator blade at a contact position that the regulator blade and the wire bar contact, the support member can adjust the contact angle within the range from 0 to 45 degrees.

9. The image forming apparatus of claim 1, wherein the regulator member is made of urethane rubber.

10. The image forming apparatus of claim 9, wherein a surface layer of the developing roller is made of urethane rubber, and a hardness of the central portion of the regulator member contacting the surface of the wire is lower than that of the surface layer of the developing roller.

* * * * *